US010555644B2

(12) United States Patent
Johnson

(10) Patent No.: US 10,555,644 B2
(45) Date of Patent: Feb. 11, 2020

(54) PRODUCT, SYSTEM, METHOD, APPARATUS, AND ARTICLE OF MANUFACTURE FOR SHOWER LINER STAY

(71) Applicant: William J. Johnson, Flower Mound, TX (US)

(72) Inventor: William J. Johnson, Flower Mound, TX (US)

( * ) Notice: Subject to any disclaimer, the term of this patent is extended or adjusted under 35 U.S.C. 154(b) by 0 days.

(21) Appl. No.: 15/922,870

(22) Filed: Mar. 15, 2018

(65) Prior Publication Data

US 2019/0282036 A1 Sep. 19, 2019

Related U.S. Application Data

(63) Continuation-in-part of application No. 15/921,029, filed on Mar. 14, 2018, now abandoned.

(51) Int. Cl.
*A47K 3/38* (2006.01)

(52) U.S. Cl.
CPC ..... *A47K 3/38* (2013.01)

(58) Field of Classification Search
CPC ..... A47K 3/38
USPC ..... 4/608
See application file for complete search history.

(56) References Cited

U.S. PATENT DOCUMENTS 4,777,673 A * 10/1988 Patteson ..... A47K 3/30 4/608
5,170,974 A 12/1992 Ruggiero
5,495,628 A 3/1996 Logan
5,732,420 A 3/1998 Micciche
5,771,504 A * 6/1998 Steiner ..... A47K 3/38 4/608
5,894,642 A 4/1999 Eberhardt
6,510,566 B2 * 1/2003 Bryce ..... A47K 3/38 4/608
6,789,279 B2 * 9/2004 Yarid ..... A47K 3/38 4/608
8,151,385 B2 4/2012 Goskowski et al.
8,826,471 B1 9/2014 Maddox
8,875,770 B1 11/2014 Martin et al.
8,898,872 B2 12/2014 Raymond
9,635,984 B2 5/2017 Pierce
2008/0184479 A1 8/2008 Bathurst
2012/0227179 A1 9/2012 Beyda
2013/0031717 A1 2/2013 Roland et al.
2013/0061386 A1 3/2013 Vagliardo
2013/0067704 A1 3/2013 Raymond
2015/0223643 A1 8/2015 Mason
2016/0106251 A1 4/2016 Ramey
2016/0135650 A1 5/2016 Ramey
2017/0202404 A1 * 7/2017 Pandaleon ..... A47K 3/38
(Continued)

*Primary Examiner* — Tuan N Nguyen
(74) *Attorney, Agent, or Firm* — Yudell Isidore PLLC

(57) ABSTRACT

A shower liner stay for holding a shower liner away from the showering area while a person is taking a shower. The shower liner stay includes one or more pensile wands to dangle on the dry ingress outside of a shower liner and adjacent the shower liner while dangling from existing hook(s) or curtain rod. Strategically affixed to a pensile wand are one or more graspers for grasping the delicate impermeable flexible surface of a shower liner for keeping the shower liner in place regardless of strong aerodynamic conditions during a shower. Customary and normal operation of the shower liner remains.

14 Claims, 13 Drawing Sheets

(56) References Cited

U.S. PATENT DOCUMENTS

| | | | | |
|---|---|---|---|---|
| 2017/0290468 | A1 | 10/2017 | Raymond | |
| 2018/0014698 | A1 | 1/2018 | Barrett | |
| 2018/0344099 | A1* | 12/2018 | Gross | A47K 3/38 |

* cited by examiner

PRODUCT, SYSTEM, METHOD, APPARATUS, AND ARTICLE OF MANUFACTURE FOR SHOWER LINER STAY

CROSS-REFERENCES TO RELATED APPLICATIONS

This application is a continuation in part and claims benefit of application Ser. No. 15/921,029 filed Mar. 14, 2018 and entitled "Product, System, Method, Apparatus, and Article of Manufacture for Shower Liner Stay", which application is hereby incorporated by reference in its entirety as though fully and completely set forth herein.

TECHNICAL FIELD

The present disclosure relates generally to bathtub and shower products, and more specifically to a system designed to hold a shower liner away from the showering area while a person is taking a shower.

BACKGROUND

A shower liner is frequently used to keep running water within a bathtub during a shower. A shower liner typically has up to twelve grommet holes at the top, and it hangs from a set of hooks that each engages with a grommet hole. The shower liner collectively hangs at a slight angle into the tub from a curtain rod installed above the outer edge of the bathtub, and may share the hooks with a shower curtain, which is a second hanging end to end (e.g. wall to wall for length of bathtub) flexible sheet of material (like shower liner) frequently used for decorative or aesthetic purposes. The decorative shower curtain is typically on the outside (dry side) of the bathtub, and the shower liner remains inside the bathtub. Due to the flow of water and air during a shower, in particular with recent advancements in water saving and high pressure showerhead designs, the shower liner tends to swell inwardly toward the showering area, which is the area within a bathtub where a person stands during a shower. The shower liner can swell inwardly and occupy space in the showering area thereby interfering with an enjoyable shower. The shower liner may also touch, or cling to, the body of the person taking a shower. This is an annoying situation for the person standing in the tub, and interferes with a timely shower.

Prior solutions are generally inadequate to keep the shower liner away from the showering user. Magnets placed at the shower liner bottom edge are useful, but do not keep the shower liner from swelling with air onto the person taking a shower when a high pressure showerhead is used. Other solutions with some effectuality are bulky, and expensive to manufacture, package and ship. Customary and convenient operation of the decorative shower curtain and liner, for example when collapsing or opening using existing solutions, will be negatively affected. A heavy shower liner is cost prohibitive when compared to very inexpensive and thin disposable or washable shower liners. A low cost, completely effective product, system, method, apparatus, and article of manufacture is needed for keeping an inexpensive shower liner in place.

SUMMARY

The present disclosure is a product, system, method, apparatus, and article of manufacture implemented to hold a shower liner away from the showering area while a person is taking a shower (i.e. a shower liner stay). Disclosed are embodiments for the shower liner stay and components thereof. In preferred embodiments, the shower liner stay includes at least one pensile wand to dangle on the dry ingress outside of a shower liner and adjacent the shower liner while hanging from the existing hook(s) or curtain rod. Affixed to a pensile wand is at least one grasper (preferably adjustable) for grasping the delicate impermeable flexible surface of a shower liner for keeping the shower liner in place during a shower. Customary and normal operation of the shower liner remains unaffected by a shower liner stay installation. Depending on an embodiment, the grasper may be completely or partially embodied on the outwardly facing ingress side (i.e. the dry side) of the shower liner. In other embodiments, the grasper includes a shower liner stay grasper portion (i.e. a coupling member) on the inwardly facing egress side (i.e. the wet side) of the shower liner for grasping the shower liner by providing a sandwich coupling. A shower liner stay pensile wand preferably hangs with a shower liner stay pendent terminator for hanging from an existing curtain rod or existing hook.

Many advantages of the present disclosure are found through implementing a variety of embodiments for a shower liner stay without departing from the spirit and scope of the disclosure. In magnetic coupling embodiments, small magnets can be installed to the showering wet side of the shower liner for being inconspicuous, or large magnetic integrated teething-able objects can be installed to the showering wet side of the shower liner for being safe for a young child. In mechanical coupling embodiments, there are many different embodiments of graspers and alternatively matching grasper portions (i.e. coupling members on inside egress and wet side of shower liner) to enable a coupled engagement for sandwiching the shower liner, some tiny for being inconspicuous, some decorative, and some that ensure a child is safe from a choking hazard.

One aspect of some embodiments is in providing a very low cost solution as: comprised by a product, mailing of the product, and maintaining of the product. Practical solutions are manufactured inexpensively. Also, an inexpensive article of manufacture (e.g. a product) can be conveniently packaged for minimum cost mailing because of component length and light weight. Shower liner stay components (i.e. pensile wand(s), grasper(s) (and grasper portion(s) if applicable), pendent terminator(s), connector(s) if applicable, padding entity(s) if applicable, adhesive component(s) if applicable, and any other components included in product packaging) can be controllably manufactured for minimizing the length, weight, and dimensions of pensile wands and other components to minimize mailing and shipping costs.

Another aspect of some embodiments is in producing many embodiments for decorative purposes, personal tastes, and competing licensable products to create a new market category for shower liners as advancements become popular in high pressure showerheads, as well as inexpensive microthin disposable shower liners. The shower liner stay is designed and implemented with a variety of available materials and in a variety of different configurations. Choices enable competitive pricing, products meeting individual tastes or preferences, and performance criteria to be applied to a specific subset of shower liner stay features.

Another aspect of some embodiments is in producing a very simple product for installation and subsequent maintenance. Product instructions are brief. No tools or glues are required for assembly in many preferred embodiments. Some embodiment products can be packaged as components convenient for assembly. Product installation is very easy and quick while preventing future maintenance by remaining without modification completely on the dry outside of the shower liner. For embodiments using wet side grasper portion(s), the wet side grasper portions are removable when cleaning or replacing a shower liner, and they are at a height requiring little to no cleaning (unlike magnets installed at filthiest part bottom corners/edges of existing shower liners).

Another aspect of some embodiments is in maintaining existing aesthetics of an existing shower installation, in particular the most commonly used installation of a shower liner and outside decorative shower curtain used together. Shower liner stay pensile wands dangle on the dry ingress outside (i.e. user ingress to Bathtub/shower) of the shower liner, and between a decorative shower curtain and the shower liner so they are hidden from view. In grasper-only embodiments for using the decorative shower curtain for support, graspers may be hidden from views. A pensile wand together with a pendent terminator is preferably less in length than a standard 72" tall shower liner and shower curtain for also being undetected at the base of the shower liner or shower curtain. The preferred length of a pensile wand together with a pendent terminator is also suitable in operation of handling taller (e.g. 78" tall) shower liners/curtains. A plurality of pensile wands dangling adjacent the shower liner is hidden from the outside view (i.e. view from ingress side to bathtub/shower/liner, outwardly side of bathtub/shower/liner, dry side of bathtub/shower/liner, user entry side of bathtub/shower/liner) of the bathtub/shower when a decorative shower curtain is in use. The plurality of pensile wands dangling adjacent the shower liner is also virtually hidden for many shower liners from the inside view (i.e. view from egress side to bathtub/shower/liner, inwardly side of bathtub/shower/liner, wet side of bathtub/shower/liner, user exit side of bathtub/shower/liner, showering area side of bathtub/shower/liner).

Other aspects of some embodiments include minimizing weight to an existing curtain rod and minimizing space used adjacent the shower liner. Pensile wands and other components are constructed of lightweight, yet rigid, material to accomplish objectives. In fact, the shower liner is easily collapsed or spread out without affecting operation, as though there were no shower liner stay installed.

Another aspect of some embodiments is in providing flexible adjustability of points where a shower liner is held in place. Recent advancements in water conservation have resulted in high pressure showerheads causing excessive movement and swelling of shower liners. Furthermore, advancements in shower liner materials have resulted in very thin and inexpensive materials which are disposable, machine washable, tolerant of lengthy periods of use without mold or mildew, yet are highly responsive to undesirable aerodynamic conditions during a shower. Undesirable aerodynamic shower situations are affected by very thin impermeable shower liners, showerhead varieties such as high pressure showerheads, bathroom fan exhaust operation, showerhead settings, air conditioning vent locations and operation, bathroom architectures, window openings, combinations thereof, and other variables that may cause the shower liner to interfere with taking an enjoyable shower. Graspers (and coupled grasper portions in some embodiments) may be uniquely and adjustably located for keeping the shower liner against pensile wands (or adjacent a decorative shower curtain) at the best shower liner points given unique and particular aerodynamic showering conditions. Shower liners will remain reasonably in place without negatively impacting a shower, and without negatively impacting normal shower liner/curtain operation.

A further aspect of some embodiments is prevention of interfering with normal operation of a typical shower liner installation, with or without a decorative shower curtain. After installation in accordance with this disclosure, the shower liner (and shower curtain) can be spread out for taking an enjoyable shower, and can be thoroughly collapsed when not taking a shower. A completed installation requires no further action on the part of a shower user. A completed installation becomes one with the shower liner in operation.

Another aspect of some embodiments is minimal maintenance. In some embodiments, most, if not all, of the shower liner stay is installed on the dry outside of the shower liner for never requiring being cleaned. In fact, pensile wands and components thereof installed between the shower liner and decorative shower curtain are thoroughly protected from even getting dusty. Graspers can be completely embodied on the dry outside of the shower liner. In embodiments when grasper portions on the wet inside of the shower liner are used, the grasper portions are removable for being cleaned, for example when cleaning, washing, or replacing a shower liner. Grasper portions (if used) are also located for avoiding the bottom dirtiest shower liner locations.

Another aspect of some embodiments is in supporting the installation of high pressure showerheads designed to conserve water by lessening a Gallons Per Minute (GPM) rating or by mixing air with water output. High pressure showerheads cause significant swelling and movement in thin shower liners. However, the benefits of high pressure showerheads cannot be overlooked, not only in water conservation, but in significantly less time needed to take a shower by blasting away suds. Many people are frustrated waiting for a low pressure showerhead to thoroughly rinse away suds during a shower. Most people would like the option to save time taking a shower.

Yet another aspect of some embodiments is in consumer convenience. People can purchase very inexpensive super lightweight shower liners that will not interfere with taking a shower. The present disclosure saves significant cost over the life of a user, not to mention saving time: taking showers, replacing low cost disposable shower liners, and maintaining a permanent high quality showering experience.

DESCRIPTION OF DRAWINGS

The above and further aspects of this disclosure are discussed with reference to the following description in conjunction with the accompanying drawings, in which like numerals indicate like structural elements and features in various figures. A drawing in which an element first appears is indicated by the leftmost digit(s) in the corresponding reference number. There is no guarantee there are descriptions in this specification for explaining every novel feature found in the drawings. The figures depict one or more implementations by way of example only, not by way of limitation.

DETAILED DESCRIPTION

Figure 1A:
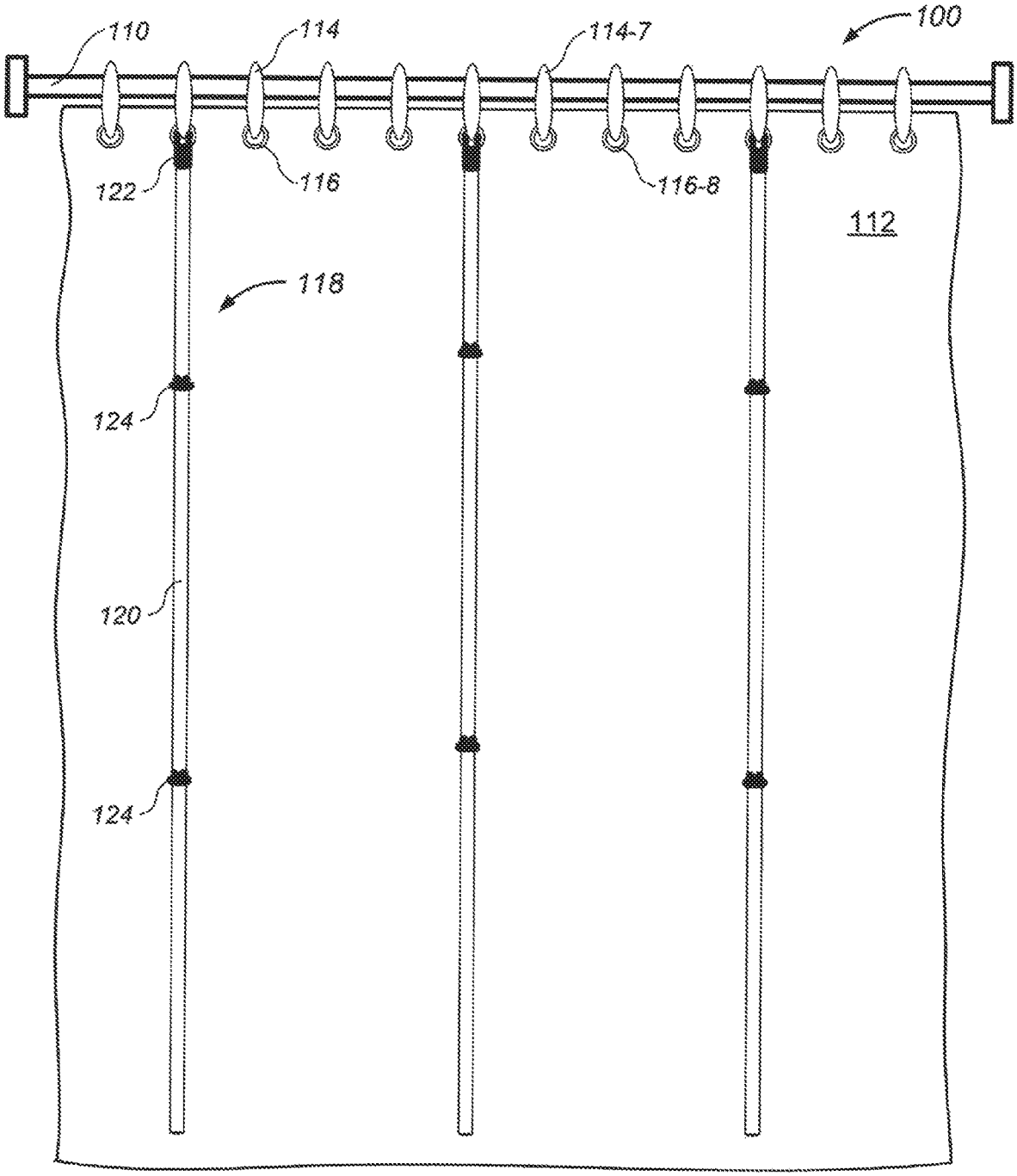
FIG. 1A depicts an embodiment installation of the present disclosure.

With reference now to detail of the drawings, the present disclosure is described. Novel features disclosed herein need not be provided as all or none. Certain features may be isolated in some embodiments, or may appear as any subset of features and functionality in other embodiments.

A delicate, flexible, thin-walled, lightweight, impermeable shower liner is kept away from a user of a shower by using an otherwise unusable surface of the shower liner (i.e. using the unprepared, unaltered, flexible and impermeable surface of shower liner). Disclosed embodiments herein grasp (e.g. grip, grab, clasp, clutch, couple to, stick to, fasten to, hold in place, or the like) the shower liner to keep it away from the user of the shower.

A shower liner stay preferably includes a plurality (e.g. 2 or 3) of shower liner stay pensile wands for dangling (an alternate embodiment hangs securely, for example in a fixed movement in one or more directions) on the dry outside of a shower liner and adjacent the shower liner while hanging from the existing curtain rod, or preferably the hook(s), with respective shower liner stay pendent terminators. Adjustably affixed to shower liner stay pensile wands is one or more shower liner stay graspers for grasping (e.g. gripping, grabbing, clasping, clutching, coupling, sticking to, fastening to, holding, sandwiching, or the like) the shower liner.

In one magnetic coupling embodiment, a grasper is a ferromagnetic spring steel clamp (or clip) that can be adjustably located anywhere along the pensile wand on the dry side of the shower liner (terminology "dry side" refers to the dry side of shower liner 112 such as shower user ingress/entry side to bathtub/shower/liner, outwardly side of bathtub/shower/liner, outside side of bathtub/shower/liner, opposite the showering area side of bathtub/shower/liner), and once positioned will stay in place through the spring steel compression to the pensile wand. Further, the grasper includes a shower liner stay grasper portion on the wet side of the shower liner (terminology "wet side" refers to the wet side of shower liner 112 such as shower user egress/exit side from bathtub/shower/liner, inwardly side of bathtub/shower/liner, inside side of bathtub/shower/liner, showering area side of bathtub/shower/liner) which is a magnet for being magnetically attracted to a respective adjacent adjustable ferromagnetic member (i.e. the spring steel clamp (or clip)). Force exerted by the magnet to the ferromagnetic member (e.g. metal clamp (or clip) containing iron, nickel, and/or cobalt) sandwiches the shower liner to keep it in place regardless of strong aerodynamic conditions during a shower. Alternatively, one or more adjustable clamp (or clip) integrated magnetic graspers affixed to the pensile wand attract a ferromagnetic grasper portion (e.g. metallic coupling member or object) on the wet side of the shower liner for similarly sandwiching the shower liner. In another embodiment, both grasper and grasper portion are magnetic, magnets, or components having integrated magnets.

In one mechanical coupling embodiment, a grasper is at least one receiving snap socket manufactured as integrated impression(s) at point(s) on a pensile wand (e.g. formed as one pensile wand, or adapted to pensile wand), or adjustably affixed to a pensile wand for being located anywhere along the pensile wand (e.g. with a compression or spring fit to the pensile wand). In this example, the grasper portion is a snap stud object placed on the wet side of the shower liner for being snapped into a dry side snap socket. This snap engagement keeps the shower liner in place regardless of strong aerodynamic conditions during a shower by using a mechanically held snap to sandwich the shower liner. There are a variety of snap designs for a mechanical engagement not causing damage to a shower liner. Alternatively, one or more snap stud graspers are similarly integrated protuberance(s) at point(s) on a pensile wand (e.g. formed as one pensile wand, or adapted to pensile wand), or adjustably affixed to a pensile wand as described above, in which case a grasper portion is a snap socket object placed on the wet side of the shower liner for similarly sandwiching the shower liner in place.

One preferred shower liner stay product disclosed herein consists of a barcode marked package containing installation instructions, advertisement collateral (e.g. packaging header with title "Shower Liner Stay" and advertisement picture facilitating immediate product understanding), and the following shower liner stay components: at least one shower liner stay pensile wand (3 in number being optimal), a shower liner stay pendent terminator for each wand, at least one shower liner stay grasper for each wand (2 in number per pensile wand being optimal) and any applicable shower liner stay grasper portions required, any applicable shower liner stay wand connectors, any applicable shower liner stay padding entities, any applicable shower liner stay skeletal links, and any other applicable components (i.e. parts, pieces, or the like) described below for making a shower liner stay. It will become apparent upon reading the Figure descriptions what each of the components entail. Components are preferably child safe (except for inconspicuous embodiments for adult use), water-proof or at least water resistant, lightweight, and inexpensive. Wherever possible, components are preferably white, clear, or translucent for a clean look, but any colors, dimensions, shapes, profiles, and materials may be used.

A component is defined as "child safe" by being appropriately sized to prevent being a choking hazard, and to be manufactured of a material safe for being touched, chewed, or abused. Components are assumed to be child safe, except where identified as not meeting child safe requirements.

The terminology "plastic" used herein refers to any of the wide range of synthetic or semi-synthetic organic compounds that can be molded into solid objects, for example amorphous thermoplastics (ABS, Acrylic, Kydex, Noryl, PETG, Polycarbonate, Polystyrene, Polysulfone, PVC, Radel, Ultem, or the like), semicrystalline thermoplastics (Acetal, HDPE, LDPE, Nylon, PBT, PEEK, PET, Polypropylene, PPS, PTFE, PVDF, UHMW-PE, or the like), imidized materials (Polyamide-imide, Vespel Polyimide, or the like), and any like plastic, material, composite, foam, mixture, alloy, or combinatory formula thereof. Preferred embodiments of components are manufactured using a plastic, however components may be manufactured using any physical material (referred to simply as "material") such as metal, wood, glass, plastic, rubber, fiber, string, cord, strap, wire, paper, cardboard, organic material, inorganic material, synthetic material, or any other suitable substituted material for carrying out forming (e.g. making, molding, printing, extruding, or any other manufacture) of a component of this disclosure.

The reader shall be eased into one exemplary embodiment of FIGS. 1A through 1E to establish a foundation understanding before introducing various component embodiments. With reference to FIG. 1A, depicted is an embodiment installation of the present disclosure, for example a magnetic coupling embodiment. A shower liner stay installation 100 involves a curtain rod 110 (walls not shown) hanging an impermeable shower liner 112, usually by use of shower liner/curtain hooks 114 placed through shower liner grommet holes 116. There are many varieties of shower liner holes 116, with or without formal grommets, or manufactured with various grommet-like reinforcement. There are many varieties of hooks 114 such as clasps, binds, loops, ties, or even holes 116 designed to be threaded directly by the curtain rod 110. Terminology "hooks 114" include all hook/hanger types. There are also various curtain rod designs: telescopic, straight, curved, different shapes, different profiles, colors, sizes, designs, etc. The shower liner stay disclosed herein is designed to work with all shower liner hanging embodiments.

The typical shower liner installation depicted by FIG. 1A has a plurality of hooks 114 (e.g. 12 of them), referenced from left to right as hook 114-1, hook 114-2, . . . , hook 114-12, respectively. Hook 114-7 is the seventh hook from the left of the illustration. Similarly, there are respective shower liner holes 116, referenced from left to right as hole 116-1, hole 116-2, . . . , hole 116-12, respectively. Hole 116-8 is the eighth hole from the left of the illustration. Depending on aerodynamic conditions of a particular shower liner stay installation 100, one or more shower liner stay support members 118 (e.g. pensile wand 120+applicable components thereon) are installed. There may be one shower liner stay support member 118 installed by dangling directly from curtain rod 110, for example between hook 114-6 and hook 114-7 for symmetric appeal, or from hook 114-6 or 114-7 that is adjacent hole 116-6 or 116-7. In a two support member 118 installation, support members 118 may dangle directly from the curtain rod 110, for example between hooks 114-4 and 114-5, as well as between hooks 114-8 and 114-9, or from hooks 114-4 and 114-9 that is adjacent holes 116-4 and 116-9, for symmetric appeal. Depicted is a shower liner stay installation 100 wherein three shower liner stay support members 118 dangle from hooks 114-2, 114-6 and 114-10 that are adjacent holes 116-2, 116-6, and 116-10. While not symmetrical with respect to the shower liner, many shower liner conditions involve a stronger side aerodynamic condition to be controlled, or involve preferences by users based on entering/exiting the shower, or preferences for collapsing the shower liner. When used with a decorative shower curtain (not shown), symmetry for appearance is not of concern because support members 118 are unnoticeable. However, three support members 118 may dangle from curtain rod 110 itself for a true symmetrical install, or only the middle support member 118 could dangle from the rod itself between hooks 114-6 and 114-7 while left and right support members dangle from hooks 114-3 and 114-10 that is adjacent holes 116-3 and 116-10. In a four support member 118 shower liner stay installation 100, support members 118 may dangle directly from curtain rod 110 or from hooks 114 in a symmetrical manner similarly spread out as discussed above. It is up to the user where to dangle shower liner stay support members 118, and the shower liner stay product preferably provides shower liner stay pendent terminator(s) that can hang from either hooks 114 or curtain rods 110. Testing demonstrates that more than four support members 118 is not necessary, and as little as two support members solves most swelling problems for most shower installations. However, any number of support members may be implemented, or packaged as a product. Three support members 118 is a recommended product packaging to solve undesirable aerodynamic shower conditions for world population shower liner stay installations 100. A consumer can determine using one, two or three support members 118 after receiving the product containing 3 support members.

Figure 1B:
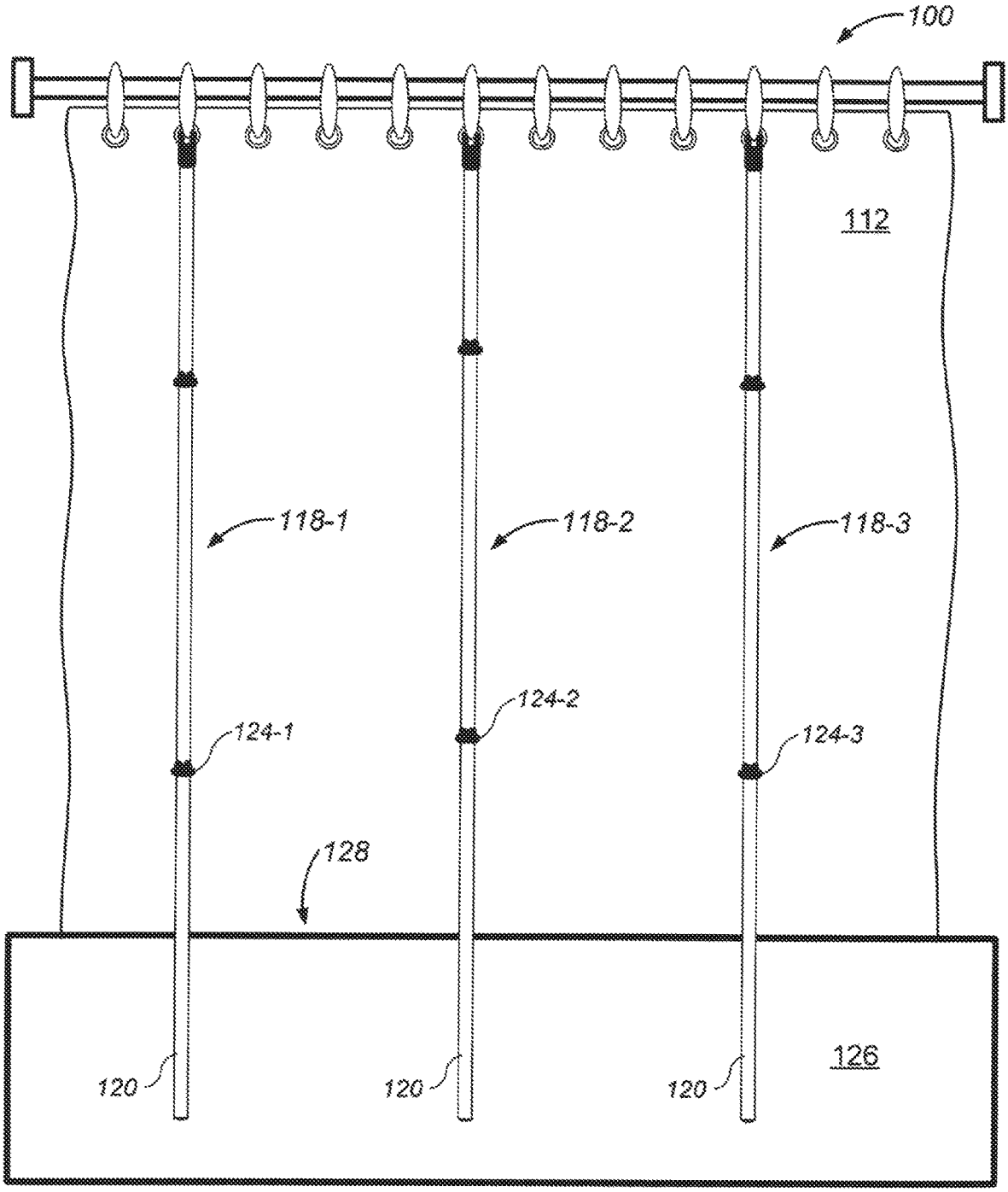
FIG. 1B depicts the embodiment installation of FIG. 1A with respect to a shower equipped bathtub.
Figure 1C:
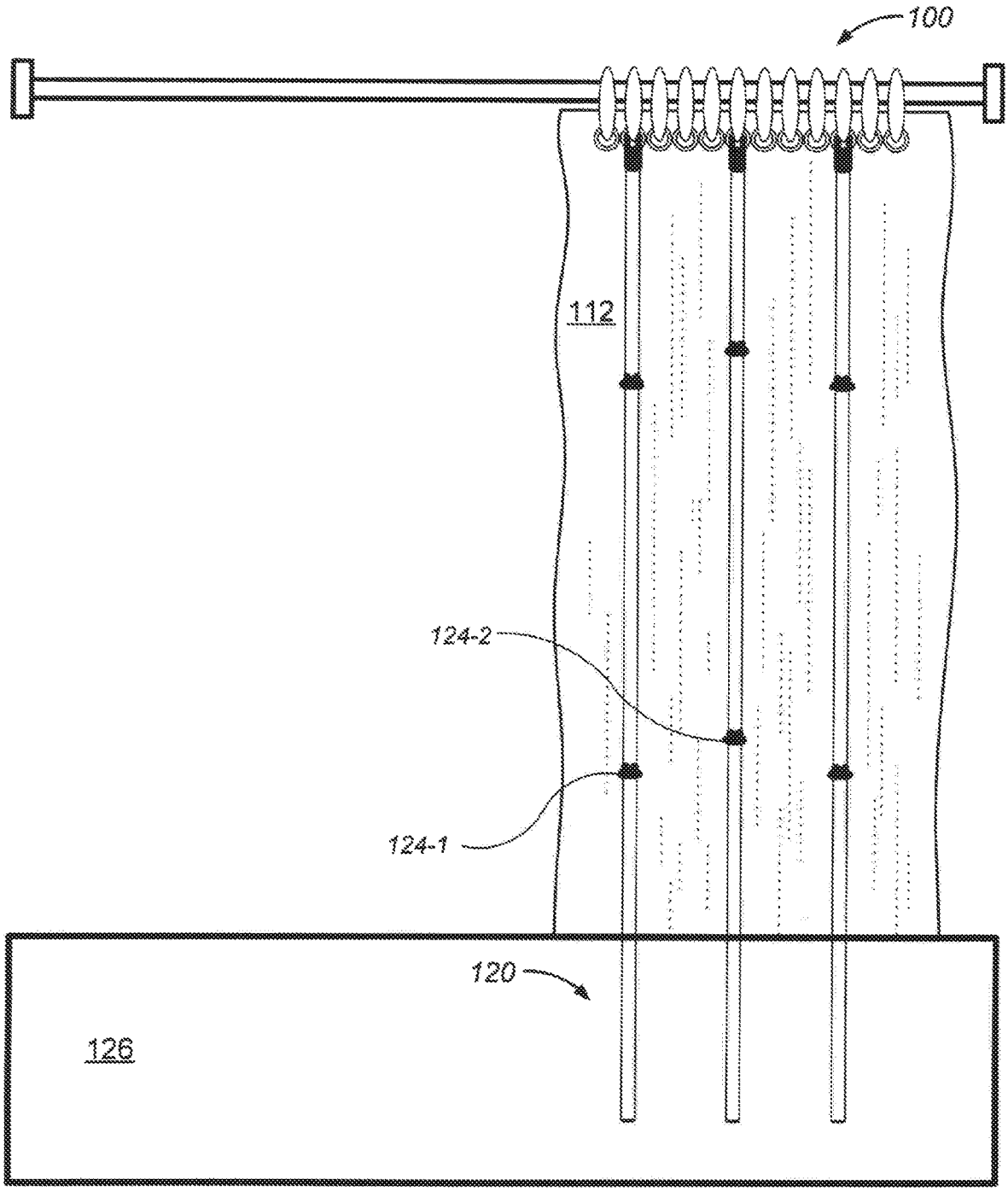
FIG. 1C depicts the embodiment installation of FIG. 1A with respect to a shower equipped bathtub when collapsing the shower liner.
Figure 1D:
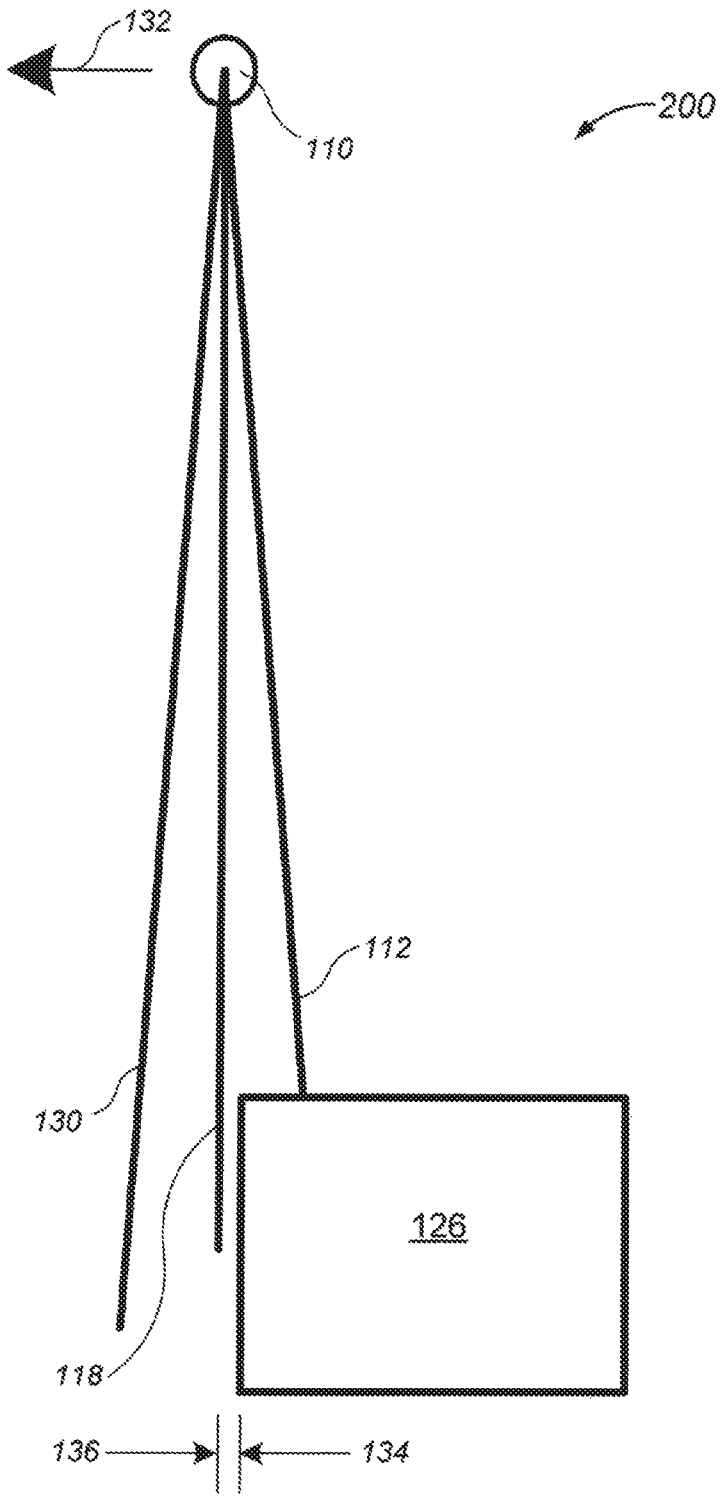
FIG. 1D depicts a side view of the preferred embodiment installation of FIG. 1A with respect to a shower equipped bathtub and decorative shower curtain.
Figure 1E:
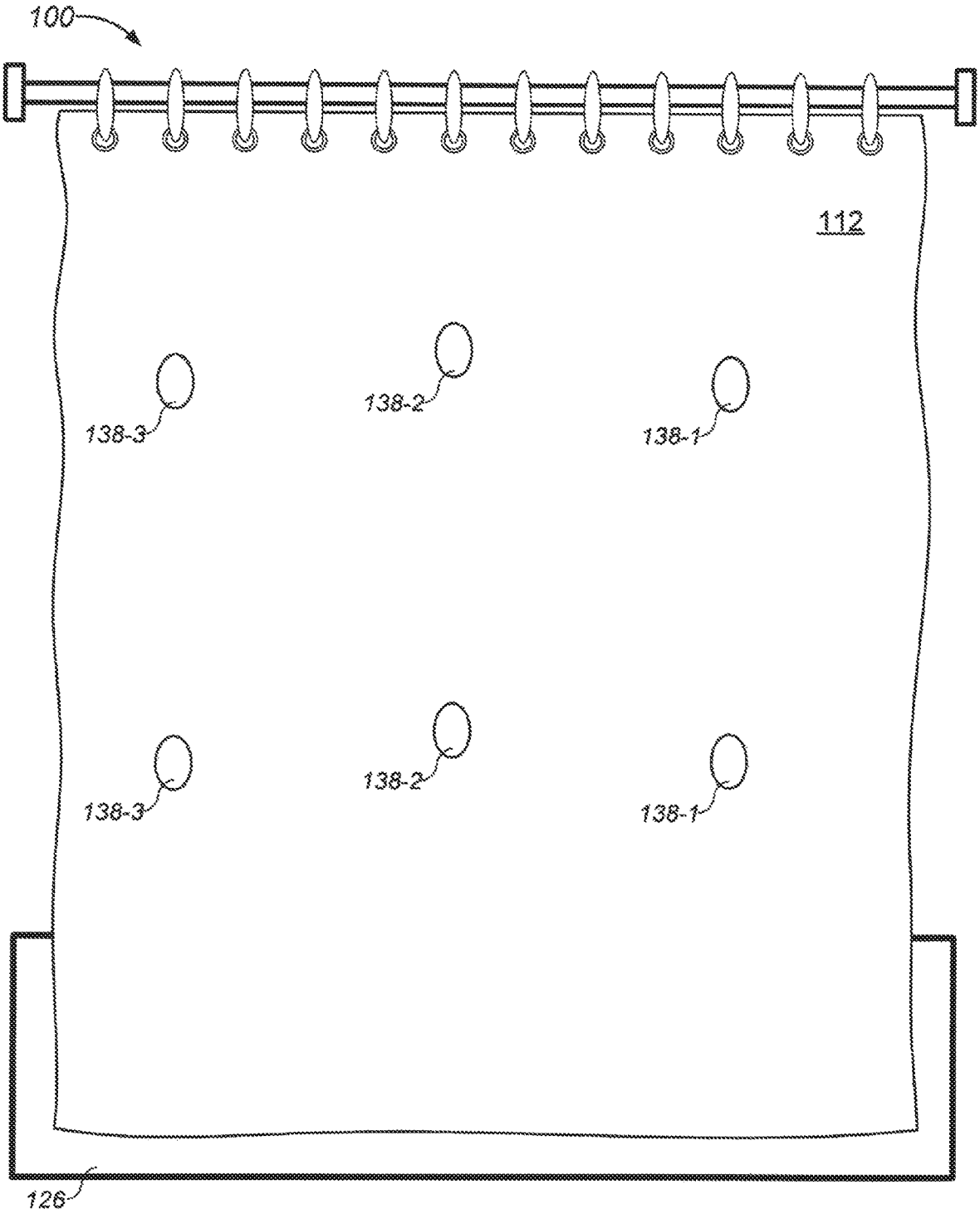
FIG. 1E depicts an in-tub view of the preferred embodiment installation of FIG. 1A with respect to a shower equipped bathtub.

In one preferred embodiment, a shower liner stay support member 118 includes a 4 mm diameter fiberglass pensile wand 120 (a vertical fiberglass rod) having a shower liner stay pendent terminator 122 and at least one shower liner stay dry side grasper 124 along with a shower liner stay wet side grasper portion 138 (FIG. 1E). The preferred 4 mm vertical fiberglass rod 120 is manufactured with 65-70% glass for maximum rigidity, a suitable resin, and having white pigment for a clean look. Shower liner stay pendent terminator 122 positions support member 118 (and vertical fiberglass rod 120 and engaged components thereof) adjacent the shower liner in an optimal manner, for example by dangling from a hook 114. A preferred embodiment for pendent terminator 122 is a hanging apparatus simply embodied as: a hole at the topmost end of fiberglass pensile wand 120 for engaging a thin diameter plastic loop (e.g. nylon loop) adjusted similarly to a zip tie, for example a small zip tie, a small nylon cable tie, a small nylon snap lock price tag fastener, a beaded zip tie, a snap lock security loop for retail clothing tag securing, a beaded security loop tie, a hang tag nylon string snap and lock, or the like. Testing demonstrates that manufacturing holes at the end of small diameter rods may be error prone, may significantly affect structural integrity, and in most cases is a cost prohibitive post-rod-manufacturing process. While it is preferred for simplicity that pendent terminator 122 be embodied as a hanging apparatus with a hole, another preferred embodiment of pendent terminator 122 is a hanging apparatus depicted in FIG. 1A as: a plastic end cap 122 placed as a terminating sleeve with a compression fit (or alternately glued) to vertical fiberglass rod 120 wherein end cap 122 has an integrated hanging member adequately or adjustably sized. The end cap may also adapt an eyelet at the end of the pensile wand 120 for being engaged with the plastic loop described above wherein the combination of the end cap and plastic loop comprise a hanging apparatus embodiment of pendent terminator 122.

A preferred embodiment of a shower liner stay grasper 124 is a 4 mm ferromagnetic spring steel band low pressure pinch hose clamp that stays tight around fiberglass vertical rod 120 while being adjustably located as desired by decreasing the spring compression of the clamp with finger pinching (or with pliers) force and moving the clamp to the desired vertical fiberglass rod 120 location. The clamps (or clips) preferably surround a majority, if not all, of the vertical fiberglass rod circumference (or perimeter for other pensile wand profile embodiments). Alternately, a shower liner stay grasper 124 is a conveniently finger pinched (or with pliers) single or double wire ferromagnetic spring steel hose clamp designed for 4 mm diameter hoses that can be located anywhere along fiberglass vertical rod 120 and kept tightly in place thereafter. Graspers 124 are ferromagnetic (e.g. metal), for example because they have contents of iron, nickel, and/or cobalt (e.g. alloy).

Dry side shower liner stay graspers 124 of FIG. 1A have a complementary wet side shower liner stay grasper portion 138 (FIG. 1E) to sandwich the shower liner 112. The shower liner 112 will stay adjacently well against support member 118 by holding shower liner 112 in place. Users can adjustably locate grasper(s) 124 as desired before placing grasper portions 138 in place. The embodiment discussed so far for FIG. 1A has grasper portions 138 being magnets. Preferably, magnet embodiments disclosed herein are coated to prevent deterioration or rust, and to enable convenient cleaning, for example a coating of plastic, rubber, epoxy, or other suitable coating to protect the magnet from "the elements". Excellent candidates include Neodymium magnets having a rubber or plastic coating, and having strength of N35 to N52 depending on size and coating thickness. Magnets 138 are preferably white in color for a clean look.

The FIG. 1A example describes graspers 124 having a compression fit. A "compression fit" includes spring action force exerted by a component completely or partially around the profile circumference (or perimeter in some embodiments) of a pensile wand 120. The compression fit may be caused by manipulation of the component (e.g. release squeezing handles of a spring steel clamp (or clip)), or may be caused by a manufactured flexibility in a surrounding component material. The terminology "sleeve" herein refers to a component which surrounds another component while exerting a "hugging" force on the surrounded component because of the material used in the sleeve. Sleeves may be rings, or split rings, depending on material. For example, a plastic tube can be a sleeve to a solid rod by the plastic tube having an Inside Diameter (ID) slightly smaller than the Outside Diameter (OD) of the solid rod. The plastic tube can be just flexible enough to be slipped over the end of the solid rod to a desired solid rod location for remaining tightly in place because the plastic tube is strongly flexible for a compression fit without sleeve damage. It is to be understood that "sleeve" is a preferred design, and suitable component designs to attach, affix, fasten, hold, grip, clasp, clutch, hug, or the like, for similar functionality is within the spirit and scope of the disclosure.

With reference now to FIG. 1B, depicted is the embodiment installation of FIG. 1A with respect to a shower equipped bathtub (referred hereinafter as "tub"). Shower liner stay support members 118 preferably dangle outside of the tub 126 while the shower liner 112 is inside tub 126 (liner 112 shown inside tub 126 by direction 128, and FIG. 1B view of tub 126 from outside tub 126). Strong aerodynamic conditions should prevent pulling the reasonably rigid support members 118 into the tub with the shower liner 112. The bottoms of the three support members 118 (shown as members 118-1, 118-2, and 118-3) supported by the outside surface of the tub prevents shower liner 112 from being pulled toward the person taking a shower, even with the lightest physical materials used to make support members 118. The contact between support member(s) 118 and tub 126 outside surface prevents, during aerodynamic conditions, inward movement of shower liner 112 toward the showering area side (i.e. wet side) of shower liner 112. Shower liner stay graspers 124 closest to tub 126 (shown as graspers 124-1, 124-2, and 124-3) should be distant enough away from tub 126 to permit collapsing and opening the shower liner (and shower curtain (not shown)) without much tub 126 friction, yet close enough to prevent swelling of the shower liner 112 at bottommost areas.

With reference now to FIG. 1C, depicted is the embodiment installation of FIG. 1A with respect to a shower equipped bathtub when collapsing the shower liner. Upon collapsing shower liner 112, shower liner stay wet side grasper portion 138 become in closer proximity to each other. In magnet 138 embodiments, this can be a concern because a user does not want magnets to interact with each other, or to interact with other shower liner stay graspers 124. Adjusting locations of shower liner stay graspers ensures no undesirable interactions. Note the different vertical placements of graspers 124-1 and 124-2 so as to avoid undesirable interactions during collapsing shower liner 112. The user can adjust graspers 124 based on neighboring support member 118 interactions as well as aerodynamic conditions.

With reference now to FIG. 1D, depicted is a shower liner stay side view 200 (as viewed from wall not shown that supports curtain rod 110) of the preferred embodiment installation of FIG. 1A with respect to a shower equipped bathtub and decorative shower curtain. Shower liner 112 is positioned inside tub 126 to ensure water stays in tub 126. Shower curtain 130 installed for decorative purposes hangs outside the tub for staying dry. Support members 118 (e.g. having pensile wands 120) dangle between the shower liner 112 and shower curtain 130 at a length to prevent visibility from outside the tub 126, but long enough to support the shower liner 112 using tub 126 as described above. Standard shower curtains and liners are 72 inches tall, so support members 118 preferably dangle by gravity a maximum of about 70 inches from the top of the shower liner 112 which entails a pensile wand 120 about 68 inches long, depending on the pendent terminator 122 embodiment at the pensile wand 120 top, and to accomplish a maximum 70 inches. Such support member 118 lengths are satisfactory in also working properly for taller shower liners and shower curtains as well, for example 78 inch tall versions.

Curtain rod 110 is best positioned a reasonable distance from the tub (i.e. increasing distance between outermost tub wall vertical alignment 134 and vertical alignment 136 describing gravity hanging plumb support member(s) 118, both vertical alignments being perpendicular to floor). Movement of curtain rod in direction 132 enables more room to take a shower in tub 126 and minimizes friction between shower line stay support members 118 and tub 126, including when there are no aerodynamic conditions. Movement in direction 132 should not be so excessive as to cause shower liner 112 from easily leaving tub 126 during a shower.

With reference now to FIG. 1E, depicted is an in-tub view of the preferred embodiment installation of FIG. 1A with respect to a shower equipped bathtub. While a person is taking a shower, they may notice the shower liner stay wet side grasper portions 138, depending on their size and color. Continuing with the example above, coated magnets 138 are magnetically attracted to the respectively adjusted shower liner stay graspers on the opposite side (dry side) of shower liner 112. In adult installations, very tiny powerful Neodymium magnets are nearly undetectable except when a swelling shower liner is being controlled during a shower. Larger magnetic objects being used for shower liner stay wet side grasper portions 138 enable child safe embodiments and enable using less shower liner stay graspers 124 because shower liner 112 can be held in place better with a large coupled wet side surface area contact presence upon shower liner 112 occupied by a grasper portion 138.

Figure 2:
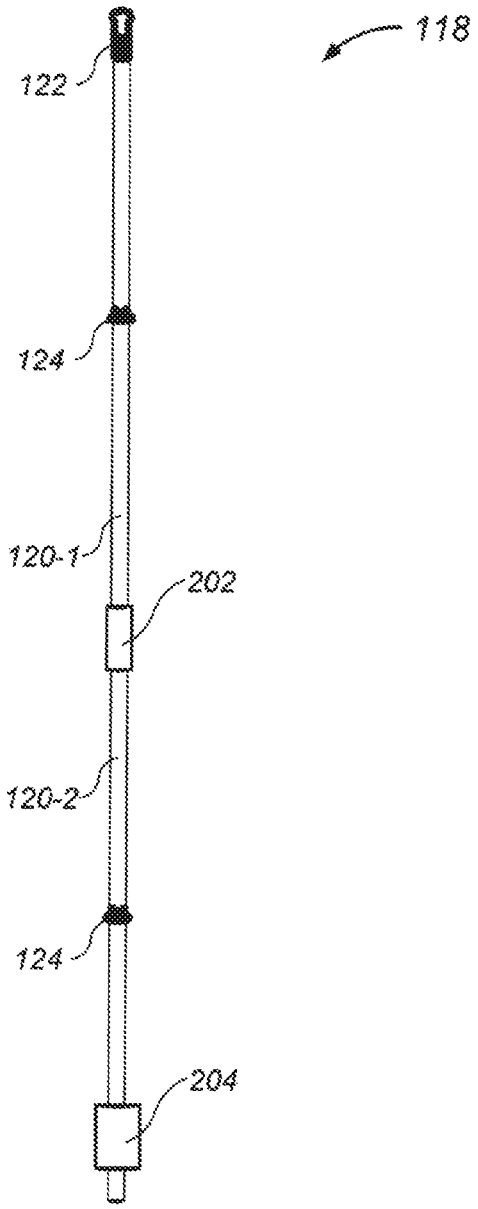
FIG. 2 depicts an alternate embodiment of a shower liner stay support member.

With reference now to FIG. 2, depicted is an alternate embodiment of a shower liner stay support member 118 which is installed to the dry side of shower liner 112. One preferred embodiment discussed includes a 4 mm fiberglass rod 120 about 68 inches long having at least one (e.g. two) adjustably located spring steel clamp/clip (i.e. grasper(s) 124) and a hanging end cap for hanging (i.e. pendent terminator(s) 122). Such a configuration is incredibly lightweight, yet very rigid for controlling a shower liner, and very supportive for coupling to small strong magnets 138. Also, support members 118 may be a single formed component. While 68 inch long rods are no problem for sales of shower liner stay products in major retailers, individual mail orders are complicated by an increase in shipping costs. In a preferred embodiment, at least one shower liner stay wand connector 202 connects a plurality of pensile wands 120, for example pensile wand portions 120-1 and 120-2. Package mailing dimensions less than 3 feet saves significantly on shipping costs. In fact, an even smaller overall mailing package can be accomplished with a plurality of pensile wand portions and a plurality of shower liner stay wand connectors 202 for achieving a total length pensile wand 120 (e.g. vertical rod portions each 4 mm in diameter).

Wand connector(s) 202 may be ferromagnetic (e.g. metal) for eliminating graspers 124. Wand connector 202 may provide attributes of a grasper 124 wherein a wet side grasper portion 138 is coupled to a wand connector 202 (e.g. either magnetic or mechanical coupling embodiments). Furthermore, pensile wand portions may be of different sizes to avoid neighboring wand connectors 202 causing undesirable magnetic coupling interactions as discussed above when collapsing the shower liner, however coupling (e.g. sandwich) locations are limited to wand connector 202 locations. For example, a shower liner stay product may include three different lengths of fiberglass vertical rods 120 (i.e. lengths for 120-1, 120-2 and 120-3) to connect with wand connectors 202 to make a 68" long vertical rod 120, for example: 29 inch, 22 inch, and 17 inch, thereby end to end making 68 inches, but 5" different in lengths to ensure no unnecessary neighboring interactions during shower liner/curtain operation. With the three different lengths included, six different top to bottom pensile wand 120 configurations can be made using wand connectors 202 to ensure no undesirable side by side interactions when collapsing the shower liner/curtain: 29,22,17; 29,17,22; 22,29,17; 22,17,29; 17,29,22; and 17,22,29. The vertical height of wand connectors 202 can be controlled for neighboring pensile wands 120 assembled from pensile wand portions 120 with wand connectors 202, and the wand connectors 202 themselves can be used to accomplish coupling (i.e. no graspers 124 required at all for the shower liner stay because connectors 202 provide double purpose). Similarly, connectors 202 may provide mechanical coupling embodiments (e.g. integrated snap coupling), as well as dry side only coupling embodiments (i.e. no grasper portions 138). For example, connectors 202 themselves may include adhesive functionality described below for one sided (i.e. dry side only) shower liner 112 grasping.

Further adapted to support member 118 may be a shower liner stay padding entity 204 installed at the bottom of support member 118 (e.g. bottom of: a pensile wand 120, or connected pensile wand portions 120). Padding entity 204 is referred to as a spacer 204 or skidder 204, depending on customer focus. Spacer 204 can be used to increase the distance between outermost tub wall vertical alignment 134 and gravity hanging plumb support member 118 vertical alignment 136. Padding entity 204 is a spacer 204 for better positioning the shower liner 112 away from the person taking a shower. Padding entity 204 is a skidder 204 for providing a frictionless touch to tub 126 when opening or closing the shower liner stay installation 100, and to prevent scratching tub 126 depending on material of pensile wand(s) 120. Padding entity 204 can of course provide both features (spacer and skidder). Padding entity 204 is preferably a compression fit sleeve by sliding tightly over pensile wand 120 at the best vertical height for interacting with tub 126.

A pensile wand 120 is vertically and perpendicularly positioned relative a curtain rod 110 with a minimally engaged area of shower liner 112, for example minimal vertically aligned and reasonably plumb shower liner 112 surface contact points for the same pensile wand 120. Terminology "pensile wand 120" used throughout this disclosure does not imply a circular or elliptical profile (e.g. for cylindrical fiberglass rod) and is completely generic in material, dimensions, sizes, and attributes. The term "pensile wand 120" used herein refers to a variety of elongated member embodiments accomplishing the identical support member 118 task of positioning components adjacent the shower liner 112 and supporting component features as described for keeping shower liner 112 in spaced apart relation to a shower user, and supporting well placed graspers 124 if applicable (or connectors 202 used for double purpose). Better cylindrical pensile wands 120 are manufactured of carbon or graphite because those materials are extremely lightweight and very strong candidates for wands 120. However, current market prices are more expensive than fiberglass. Carbon rods and graphite rods may be substantially smaller in diameter than 4 mm which is ideal, provided graspers 124 can be adapted large enough to be effective. For cylindrical pensile wand 120 embodiments (e.g. fiberglass rods), a connector 202 is preferably manufactured as a sleeve formed by a firm plastic tube about 2 to 3 inches in length (may be shorter or longer). Rod portions can be pressed into connector sleeve(s) 202 for forming an overall pensile wand 120. Plastics demonstrating good sleeve performance for a connector 202 include Low Density Polyethylene (LDPE) tubing, High Density Polyethylene (HDPE) tubing, nylon tubing, ABS tubing, PVC tubing, and Polystyrene tubing. In fact, the compression fit is so firm that smaller diameter vertical (e.g. fiberglass) rod portions 120 can be used in place of a longer 4 mm fiberglass pensile wand 120. Connector 202 is not limited to any particular material, and any plastic that meets the requirement of coupling rod portions 120 together in a cost effective manner while maintaining shower liner stay support member 118 rigidity may be used. Connector 202 need not be a sleeve. It may be a double sided screw, a dowel, a pin, a shaft, or any other means/method of connecting rod portions together to form a longer length pensile wand 120. Rod ends may be adapted in accordance with the connector 202 type. Cylindrical connectors 202 may also be used to connect pensile wand embodiments which do not have cylindrical profiles, and rectangular profile connectors 202 may be used to connect pensile wand embodiments with cylindrical profiles. Profiles of connectors 202 and profiles of pensile wands 120 may be of any shape and do not have to match to work together effectively.

For fiberglass vertical rod pensile wand 120 embodiments, a padding entity 204 (at bottom end of wand 120) is preferably manufactured as a sleeve formed by a plastic foam tubular product about 2 to 3 inches in length. Plastics demonstrating good padding entity 204 sleeve performance include Polyethylene foam tubing, Polystyrene Foam tubing (i.e. Styrofoam), and other air-infused closed cell or open cell plastic foam cut and/or extruded to a compression fit sleeve. Padding entity 204 is not to be limited to the mentioned materials. Any plastic or air-infused plastic foam that meets the requirement of a spacer 204 or skidder 204 may be used.

Pensile wands 120 may be manufactured in a variety materials or plastics. Pensile wands 120, or members 118, in some embodiments may be curved or formed of a particular shape for grasp points being at horizontally spread out shower liner 112 surface areas with a single member 118. Pensile wands 120 may be solid or hollow tubes. Pensile wands 120 can be of any color and density, although light weight is preferred. Pensile wand 120 material used as good low cost substitutes for fiberglass include hollow HDPE tubes, hollow nylon tubes, solid acrylic rods, hollow nylon tubes, and any reasonable plastic for structure not to significantly bend with a shower liner trying to swell. Pensile wands 120 may be any profile and diameter such as round dowels or tubes, square dowels or tubes, beam profile dowels, angles, or any other profile that can be matched effectively for well operating pendent terminators 122, graspers 124, applicable connectors 202, and applicable padding entities 204. In some pensile wand 120 embodiments, a rectangular profile polystyrene foam (e.g. 3 lb. Styrofoam) provides super lightweight structure, a minimum cost, and suitable rigidity for many shower liner stay installations, provided other components are similarly well matched. Superior foam products usable for pensile wands 120 include polyethylene foams and cross linked polyethylene foams. Pensile wands 120 constructed of such material will have larger dimensions (e.g. diameter, thicker rectangular profile, etc), but will be lighter than fiberglass, wood, or metal rods.

Pensile wands 120 may simply be a solid 14 gauge wire, or higher gauge (i.e. smaller diameter) ferromagnetic metal wire for the entire length, for example like as used in a low cost dry cleaner wire hanger. In fact, such a wire embodiment only requires manufacturing to cut the wire to length and to bend one end (the top) to a hook configuration for easily making pendent terminator 122 using the wire itself. In magnetic coupling embodiments, using a wire includes a continuous running length of graspers 124 because magnets 138 (i.e. grasper portions 138) can be coupled anywhere along the entire length of wire at the wet side of the shower liner. As long as collapsing the shower liner is not an issue for magnet interference, this embodiment is acceptable. Padding entities 204 may be required to prevent scratching of tub 126. Poorly treated metal in damp conditions may produce rust over time (therefore coated wire embodiments are preferred), and magnetic interference involves the entire length of the wire when opening and closing the shower liner (therefore smaller magnets are preferred). Weight of wire is also significantly more than fiberglass, carbon, graphite, or light plastic embodiments discussed above.

A pensile wand 120, pensile wand portions 120-1 and 120-2, or a plurality of pensile wand portions for various embodiments need not be constructed of 4 mm fiberglass. Any diameter fiberglass and glass percentage recipes apply, as well as any other material meeting reasonably rigid shower liner stay support member 118 requirements of holding back a shower liner 112 without breakage or significant bending. Pensile wands 120 (and other shower liner stay components) may be constructed of any material. There are many options and materials to accomplish manufacturing of shower liner stay support member 118 components. Depending on shower configurations, a showering area architecture edge may be like the outer surface of tub 126 for restricting inward movement of support members 118. Also, support member 118 embodiments may be of sufficient weight to alternatively hang on the dry side of shower liner 112 for dangling on the inside of tub 126 while still supporting shower liner 112 from swelling. In many embodiments, shower liners 112 with magnets in bottom corners, or side gap control methods, may still be useful. Members 118 may be decorative, for example when no shower curtain 130 is used.

A pensile wand 120 may further provide convenient manual operation (opening, spreading, collapsing) of shower liner 112 (and an installed shower curtain 130, for example if installed to an appropriate hook 114, or to curtain rod 110). A support member 118 may also provide additional purpose to facilitate manual operation.

Figure 3:
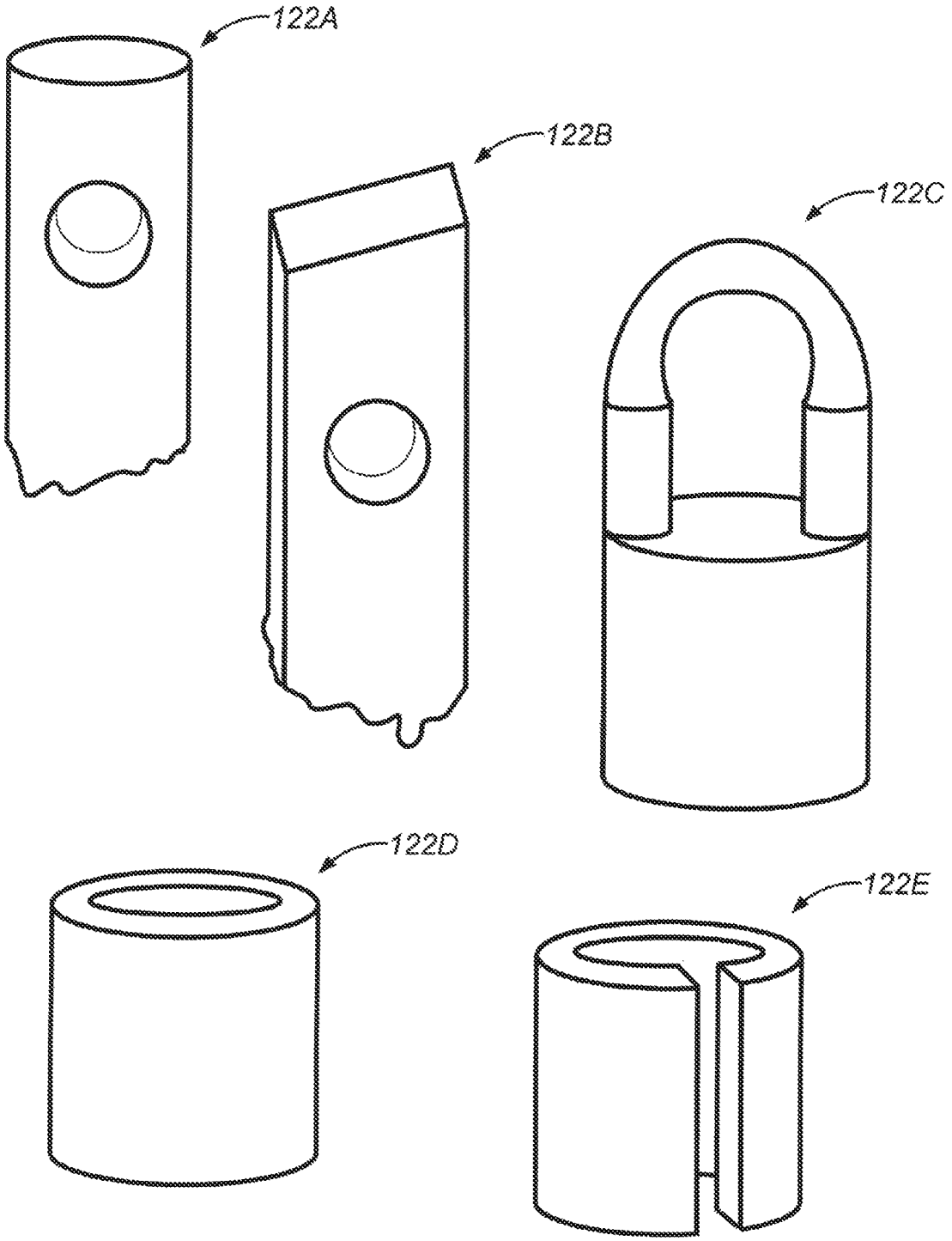
FIG. 3 illustrates alternate embodiments of shower liner stay pendent terminators.

With reference now to FIG. 3, illustrated is alternate embodiments of shower liner stay pendent terminators 122. As discussed above, pensile wand 120 may include a manufactured hole at the top end as illustrated in breakaway top pensile wand 122A wherein a plastic tie (i.e. discussed above) can be used to hang the pensile wand 122A from a hook 114 or curtain rod 110. Alternatively, cord, strap, wire, string, or any other material may be used for accomplishing hanging with a loop the pensile wand 120 using the hole in pensile wand 122A. Pendent terminator 122 may be referred to as a hanging apparatus comprised of the hole and hanging material or method used. The hanging material used is preferably adjustable in length to adjust the size of the loop. In another embodiment, a hook or open ended hanger member manufactured of plastic, wire, or suitable material, can be used by inserting one end through the hole of pensile wand 122A and the other end over the hook 114 (or curtain rod 110). A variety of hooks (e.g. well known S hook or C hook, J hook, D hook, G hook, P hook, or any other type of open ended hook) may be used as a hanger of the pensile wand 122A. Further, a split ring (e.g. used for keys and also considered a loop) may be used through the hole to suspend pensile wand 122A. In some embodiments, additional hooks 114 may be installed to specifically dangle support members 118.

Generally speaking, a hanging apparatus for pendent terminator 122 will include a loop or a hook, and in some embodiments a belt. A belt is a strip of material more wide than thick and may be secured by tie, adjusting, or separating weaves to make a hole in the belt to hook 114. As discussed above, rods 120 are not limited to a circular or elliptical profile, for example as illustrated in breakaway top pensile wand 122B having a top hole wherein the hole is used in a similar manner as already described. Pensile wands 120 with a flat surface against tub 126 provide good anti-turn stability, for example for not using a padding entity 204.

Pendent terminator 122C comprises a hanging apparatus embodiment of an end cap for a push-on sleeve for a tight compression fit around the end of a pensile wand 120 with an included eyelet portion suitable for hanging from a hook 114. To highlight pendent terminator 122, pendent terminator 122C is shown in black in FIGS. 1A, 1B, 1C, 2 and 7A. The eyelet portion may be made large enough for optionally hanging directly from the curtain rod 110, and the eyelet portion may be a hook or belt, rather than a loop as shown. Pendent terminator 122C can be compression fit to a variety of profiles, and the eyelet portion may be firm or flexible for supporting hanging loops, hooks, belts, or other material for a hanging apparatus. Preferred embodiments of pendent terminator 122C uses plastic, but any other material may be used. Pendent terminator 122C may also be hung like the holes of pendent terminator 122A and pendent terminator 122B.

Pendent terminator 122D is a very low cost option push-on sleeve for a tight compression fit around the circumference end of a pensile wand 120. Sleeve 122D pushed onto the top of the rod can be used to securely hold a hook, loop, or belt at the end of pensile wand 120 by inserting a portion of the loop, hook, or belt to the inside of the sleeve before pushing onto pensile wand 120. The compression fit firmly keeps the loop, hook, or belt in place for in turn hanging from a hanger 114 or curtain rod 110. In fact, pendent terminator 122D supports a minimal cost flexible string, wire, plastic (e.g. nylon) string, or strip of material that can be made into a loop by pressing the ends inside the sleeve and pushing the sleeve onto pensile wand 120 for very securely holding both ends before hanging pensile wand 120. Split sleeve 122E is a split version of sleeve 122D pushed onto the top of the pensile wand 120 for identical use like sleeve 122D. Split sleeve 122E may be manufactured of a denser or stronger material with strong spring action, even spring steel, for securely holding a hook, loop, belt, etc. similarly as described for sleeve 122D. Thus, pendent terminator 122 embodiments include fitting an entire circumference (or perimeter in other rod profiles), or partial circumference (or perimeter in other rod profiles) of pensile wands 120. C clips are also well known components suitable for carrying out sleeves 122E, and they come in many dimensions and materials.

In other embodiments, pendent terminator 122 may be a screw eye, or screw hook screwed into the end of pensile wand 120, and may be self tapping. Wire or firm plastic may be pushed into the pensile wand 120 material (e.g. LDPE or HDLE) for adapting a hook or loop. Rivets and grommets may be used to strengthen holes in pensile wands 120. Pensile wands 120 may also be constructed of a material wherein a hook or loop is integrated (formed as single component, or adapted as attached components), or the end of pensile wand 120 may be post manufacturing user manipulated to a desired hanging configuration. Thus, there are many embodiments, flexible or firm.

In another embodiment, pendent terminator 122 may be affixed directly to shower liner 112 with tape, a sticky surface, a double-sided self-sticking pad, Velcro, a suction cup, a magnetic coupling, a mechanical coupling, or by another direct attachment. In such a configuration, pendent terminator 122 components may provide double purpose for additionally service as a grasper (e.g. to a magnet 138). Viewed another way, a grasper 124 can have additional purpose for replacing a pendent terminator 122. In yet another embodiment, pendent terminator 122 hangs from a hole 116.

Figure 4A:
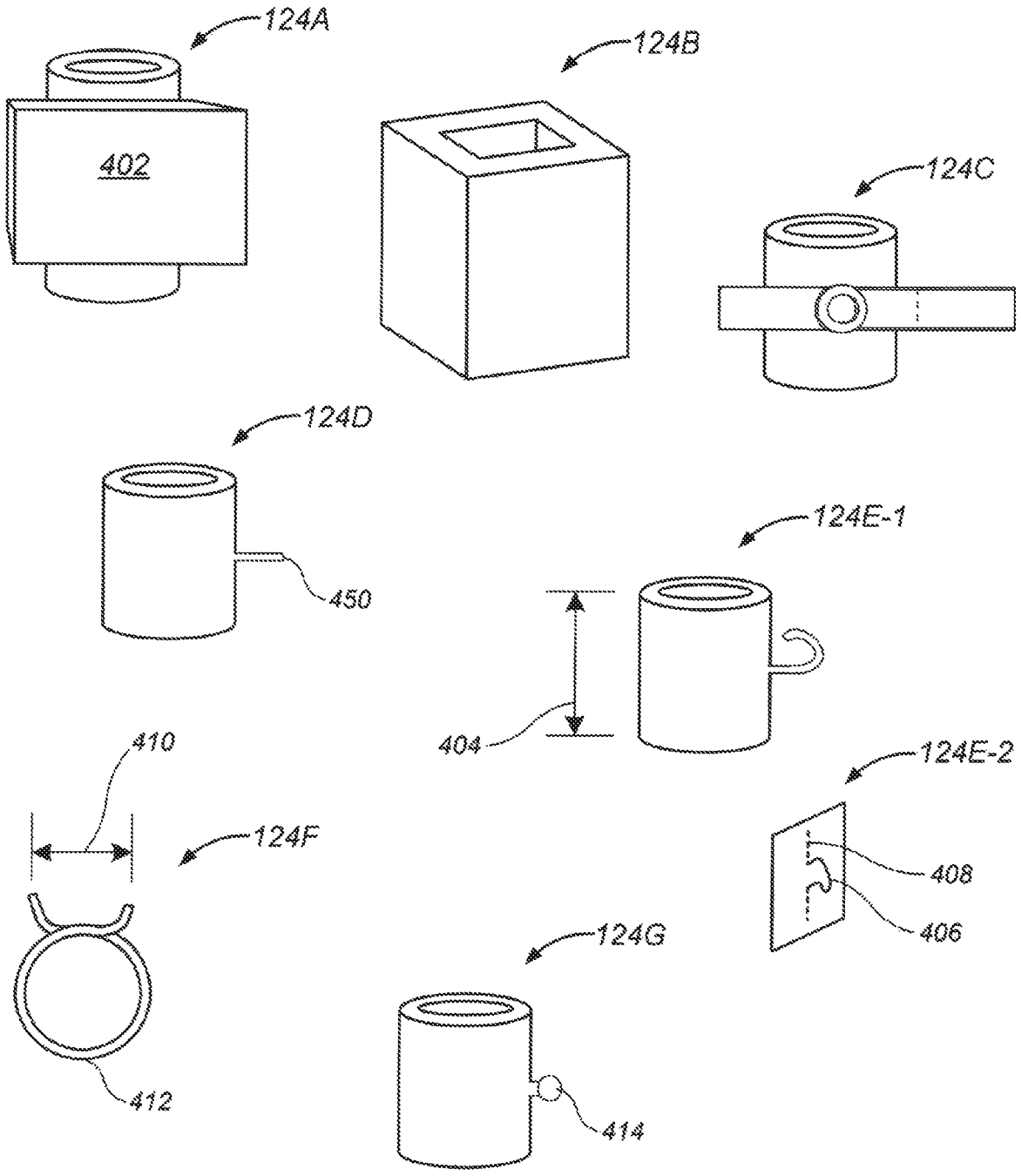
FIG. 4A illustrates alternate embodiments of shower liner stay graspers.

With reference now to FIG. 4A, illustrated is alternate embodiments of shower liner stay graspers 124. A grasper 124 grasps (grabs, clasps, clutches, couples to, sticks to, fastens to, binds with, holds, sandwiches, affixes to, attaches to, hugs, engages, or the like) the lightweight shower liner 112 at the delicate flexible impermeable surface of shower liner 112. No special or altered feature of shower liner 112 to accommodate a grasper 124 is required. Graspers 124 are installed to the dry side of shower liner 112. While components 124A, 124B, 124C, 124D, 124E, 124F and 124G (i.e. graspers 124) show a compression sleeve fit around the entire profile perimeter of pensile wand 120 embodiments, it should be understood that any components 124 may be split rings, C clamps, clips, different shapes/sizes/materials, of different materials, and by any reasonable manufacturing process to accomplish a grasper to a pensile wand 120. Many preferred shower liner stay embodiments do not require wet side grasper portions 138 at all, so that the entire shower liner stay (a system) remains on the dry side of shower liner 112 for maintenance free operation. In some embodiments, graspers are configured like grasper 124A which includes a push-on tight compression fit sleeve to a pensile wand 120. Grasper 124A includes an integrated face 402 (formed as one component 124A, or affixed to the sleeve) for accommodating any of a variety of innovative double sided adhesives or gels such as reusable adhesive putty, "sticky tak" products, poster putty products, reusable sticky gel pads, adhesive gel pads, rewashable and reusable adhesive pads, Stikk gel pads, sticky silicone gel pads, similarly named products, or the like. Also, double or single sided tapes (e.g. from 3M corporation) may be used (preferably they are removable and reusable). Face 402 may take on any dimension or shape for providing a sufficient area to support a double sided adhesive to adhere (i.e. couple, bond, bind, hold, link, fasten to, affix to, stick to, attached to, or the like) to shower liner 112 as described. Grasper 124A may come packaged with the double sided adhesive already applied to face 402 with a removable protective film covering over the side to contact the shower liner 112, or a plurality of double sided adhesive gels, tapes, putties, or the like (described above) will be provided as packaged product components with the shower liner stay product. For shower liners 112 that are disposable, the double sided adhesive may be permanent (or semi-permanent), so replacing with a new shower liner 112 causes using extra adhesive components included in the product package. The sleeve, face 402, and adhesive comprises a shower liner stay grasper 124A wherein no wet side grasper portion 138 is required. In some embodiments, graspers 124 are simply adhesive components (e.g. gel, putty, or tape) applied directly to pensile wands 120 by the user during installation. In some embodiments, graspers 124 provide simply an attachable adhesive side (e.g. gel(s), tape(s) already attached to pensile wand 120), or wand adhesive sections/portions thereof, configured with a protective film covering to be removed at user installation to shower liner 112.

Regardless of grasper 124 embodiments disclosed, shower liner stay installation 100 is similar. For example, grasper(s) 124A are placed onto the rod for an adjustable tight fit (if not already well placed). Exact positions may be adjusted later. Shower liner 112 is spread wide as though a shower is being taken. Support member(s) 118 are secured with pendent terminator(s) 122 for being adjacent the shower liner 112 at the best position(s) (e.g. best hooks). When support member(s) 118 are comfortably plumb in place with gravity, graspers 124A may be rotated for face 402 to directly face the shower liner 112 to maximize surface contact, and graspers 124A are adjusted to the best vertical height(s). Tests demonstrate that best locations for two component(s) 124A on a single support member 118 are about 2 feet from the shower liner 112 top and about 4 feet from the shower liner 112 top assuming an overall support member 118 of 70 inches in length from the shower liner 112 top. Once adjustments are made and shower liner 112 is hanging comfortably from side to side (end to end length of tub 126), the adhesive can be applied (if not already there) to face 402 and pressed against the shower liner 112, after removing a protective film covering, while carefully avoiding wrinkles. Once all faces 402 are sticking to shower liner 112 via an adhesive as described above, installation is complete. The shower liner/curtain can be collapsed and operated as though no shower liner stay was installed. An unaware user may not notice a shower liner stay installation 100. Grasper 124B may already be shaped with a face 402 for convenient compression fit to pensile wand 120 and a sufficient area to support a double sided adhesive. Note that alternate embodiments of components 124A and 124B support Velcro adhesive as well. Velcro has become so inexpensive that Velcro engagement surface 1 of 2 can be affixed to a face (e.g. 402) for engaging Velcro engagement surface 2 of 2 sticking to the liner with an adhesive backing. The Velcro will continue to operate properly after washing shower liner 112, and extra Velcro engagement surfaces 2 of 2 can be provided for additional new shower liners.

Grasper 124C is integrated with an alligator clip arrangement, preferably for pinching a shower liner 112 in a direction parallel to the bathroom floor. The alligator clip may include rubber, foam, or other soft pinching surfaces for preventing shower liner 112 damage. Positioning/adjusting grasper 124C is best achieved with the alligator clip perpendicular to shower liner 112 when the shower liner 112 is spread out well, and support member 118 is comfortably dangling in a reasonably plumb position. Similar to grasper 124C, a suction cup (not shown) may be integrated to the sleeve (e.g. affixed or formed as one piece) instead of an alligator clip. The suction cup (e.g. silicone or gel) enables coupling to one side of the impermeable surface of shower liner 112. Grasper 124D is integrated with a reasonably sharp stud for poking through a disposable shower liner 112. Positioning/adjusting grasper 124D is best achieved with the stud perpendicular to shower liner 112 when support member 118 is secured comfortably as described above and the shower liner 112 is spread out comfortably. Once poked through the disposable shower liner 112, a complementary cap 138 can be installed as wet side grasper portion 138 for preventing water leakage and for sandwiching shower liner 112. Grasper 124D may include a mushroomed tip, protruding nub, increasing diameter, or other slip prevention feature at or near tip 450 to hold (engage securely in male/female mated position) the cap 138 better in place. Grasper 124E-1 includes an integrated hook for engaging a loop stuck to shower liner 112 with an adhesive (e.g. 124E-2). Such a loop is very inexpensively adapted to shower liner 112 using a reusable or permanent adhesive on the disposable or reusable shower liner 112 dry side as described above (additional adhesive backed loops 124E-2 can be provided in the packaged product for newly replaced shower liners 112). For example, loop 406 may be stitched 408 into a fabric of the adhesive material, or have ends poked through the adhesive material and secured to back with adhesive backing as shown with hidden lines 408. The hook design of grasper 124E-1 may require a sleeve with a minimal length 404 to be most cost effective (so to can components 124C, 124D, 124F and 124G).

Grasper 124F comprises a band style clamp 124 shown as black in FIGS. 1A, 1B, 1C, 2 and 7A, and described above. A profile of grasper 124F is shown because there are various choices including one wire clamp, double wire clamp, band style clamps, and other clamp or clip designs, for example in spring steel. Such clamps (or clips) can be operated by squeezing handles to minimize distance 410 for increasing the clamp (or clip) diameter to install on pensile wand 120, or adjust thereon. Any of the integrated features of FIG. 4A grasper 124 components (clips, adhesives, studs, hooks, sockets, mechanical coupling embodiments, magnetic coupling embodiments, male/female mating component embodiments, or the like) can be adapted or integrated to grasper 124F, preferably at point(s) 412 directly opposite adjustment handles. Grasper 124F in spring steel provides an excellent ferromagnetic grasper 124 for engaging a magnet 138 on the opposite side of a shower liner 112. Grasper 124A, 124B, and graspers similarly designed to 122D and 122E provide excellent ferromagnetic graspers 124 for attracting a magnet 138.

Grasper 124G includes a male snap stud 414 for engaging a female snap socket in a wet side grasper portion 138 for sandwiching liner 112 with a snap engagement. While a typical snap, or stud to socket, embodiment typically used in clothing may suffice, the snap of grasper 124G is delicate to shower liner 112. Grasper 124G is preferably manufactured with an appropriate density Polyethylene foam for a firm, yet reasonably soft engagement. The complementary socket 138 is preferably manufactured with the same foam. Of course, other materials may be used to make grasper 124G and complementary socket component 138. Further, roles may be reversed wherein grasper 124 is the socket and component 138 is the stud. Other embodiments of compression fits for components 122 and components 124 are adjustable cords or straps, adjustable belts, tension clips, and the like. Graspers 124A, 124B, 124C, and 124E are dry side only (one side of shower liner 112) mechanical grasp embodiments.

Graspers 124 coupling to shower liner 112 may include a specific length of material(s) (or joining component(s)), flexible or firm in totality, whereby a specified distance is achieved between support member 118 and shower liner 112 at a grasper 124 location. For example, the sleeve (or other mount to support member 118 which is affixed, attached, coupled to, or the like, to member 118) may include integrated material, component(s) or an attached integration, to maintain a specific distance, or adjustable range of distances, between member 118 and shower liner 112, for example to provide spacing, reduce friction at tub 126, or make shower liner coupling points to shower liner 112 less noticeable. An adjustable length loop, adjustable nylon loop or tie length (as described herein), cord/strap with adjustment member (e.g. spring loaded cord lock), ratcheted zip tie arrangement of any material, or the like, may be used. In some distance maintaining arrangements, a wet side grasper portion 138 slip prevention feature (e.g. adjustably located slip prevention collar) may be included on the dry side of shower liner 112 for preventing slippage of a grasper portion 138 from shower liner 112 toward the showering area.

There are grasper 124 embodiments wherein no support members 118 are required. Graspers 124 (and complementary wet side grasper portions 138 if applicable) are the only components required for a complete shower liner stay product and system when a heavy enough decorative shower curtain 130 is present. For example, graspers 124 can be on the dry side only of shower liner 112 (similarly to 124A, 124B, 124C and 124E) while making use of shower curtain 130 for support to keep shower line 112 away from the showering area (i.e. no support members 118 required). Adhesive backed loop 124E-2 may be placed at one or more appropriate points (i.e. places/locations) on the surface of the dry side of shower liner 112, and an appropriately sized hook (e.g. well known S hook or C hook, J hook, D hook, G hook, P hook, or any other type of open ended hook, and of any material or plastic) can replace the 124E-1 integrated hook for being directly threaded through shower curtain 130 (e.g. weave of fabric) for in turn attaching to adhesive backed loop 124E-2. The hook may be small enough to be unnoticeable from the outside view toward shower curtain 130. The hook retains shower curtain 130 in close relation to shower liner 112 for shower curtain 130 being used to support shower liner 112. The hook may be of an optimal size, or have an overall length by design or adaptation, to maintain an optimal distance of vertical alignment 134 to vertical alignment 136 wherein vertical alignment 136 is representative of the shower curtain 130 being used for support, rather than a support member 118 as illustrated in FIG. 1D. Preferably, grasper 124 installation points upon shower curtain 130 (to shower liner 112) is not too close to tub 126 as to cause excessive friction when opening or collapsing the shower liner and curtain. Also, such points of shower curtain 130 (to shower liner 112) can be minimal and spread out in a similar member 118 manner without negatively impacting the decorative purpose of shower curtain 130. In a similar grasper 124 embodiment, a plastic loop can be used as described above (i.e. thin diameter plastic loop (e.g. nylon loop) adjusted similarly to a zip tie, for example a small zip tie, a small nylon cable tie, a small nylon snap lock price tag fastener, a beaded zip tie, a snap lock security loop for retail clothing tag securing, a beaded security loop tie, a hang tag nylon string snap and lock, or the like) for being threaded (or poked) through shower curtain 130 and adhesive backed loop 124E-2 before closing the loop, and perhaps adjusting it. Thus, cords, straps, belts, strings, wires, plastic ties, or the like (some adjustable for adjusting closeness of shower curtain 130 to shower liner 112) can be similarly threaded (or poked) through shower curtain 130 material (e.g. fabric) to use shower curtain 130 as a support member for retaining shower liner 112 with a grasper 124 on only the dry side of shower liner 112. In some embodiments, the hook or loop of grasper 124 is so small (e.g. diameter of a pin, or a nylon clothing price tag fastener), it can be threaded through a weave of shower curtain 130 without any presence viewable at all from the outside view (of shower curtain 130).

An integrated hook or loop 124E-1 design variation may be manufactured for an intentional presence on the outside view of shower curtain 130, for example for decorative purposes, or for ensuring shower curtain 130 retains shower liner 112 away from the showering area by preventing grasper 124 from being pulled through, or out of place from, shower curtain 130. A decorative object or body 124E-1 (rather than the sleeve shown) can include a hook, loop, or the like (may be adjustable) to press through shower curtain 130 at an appropriate point (i.e. location/place) for being engaged (coupled) to adhesive backed loop 124E-2. The decorative object or body retains shower curtain 130 to shower liner 112 so that shower curtain 130 acts as a support member when providing placed objects on the outside of the shower curtain 130 (meeting child safe requirements if necessary). Depending on a distance to maintain between (may be adjustable, or flexibly arranged) shower curtain 130 and shower liner 112, a slip prevention feature (e.g. adjustable collar) may be included to a grasper 124 adjacent, or at, the inside of shower curtain 130 to prevent the object or body (may be referred to as the head of the grasper 124) slipping away from shower curtain 130 outside shower curtain 130.

Figure 4B:
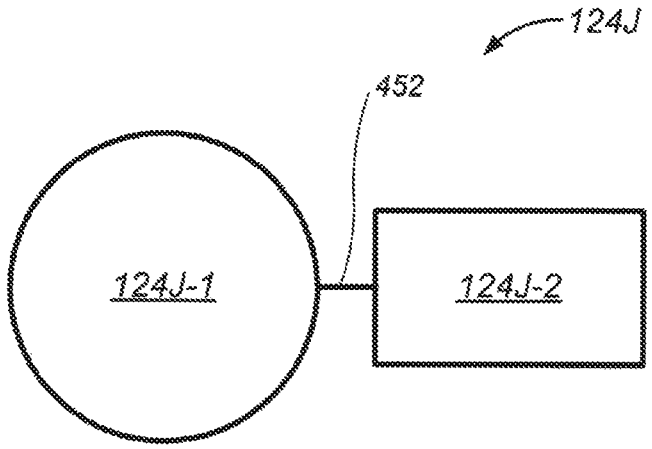
FIG. 4B illustrates alternate embodiments of shower liner stay graspers when using a shower curtain as a support member.
Figure 4B:
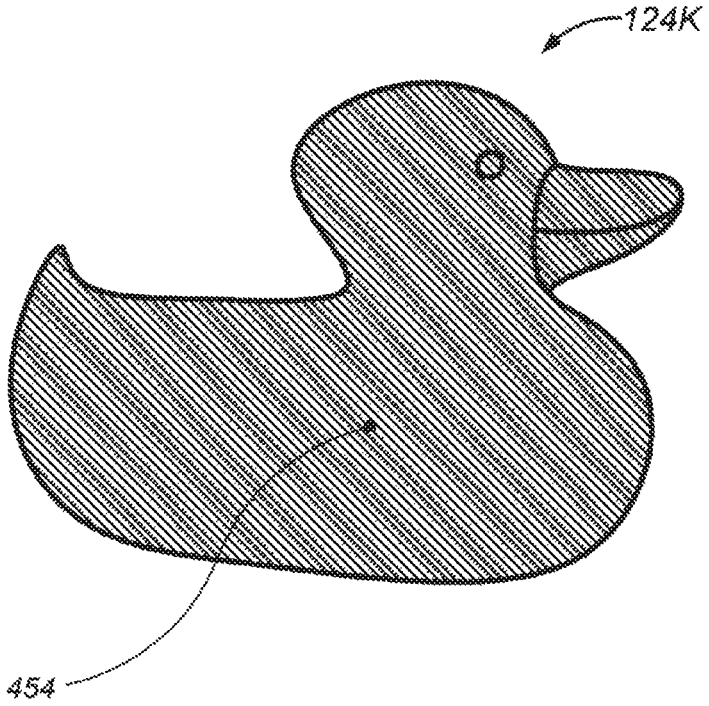

With reference now to FIG. 4B, illustrated is alternate embodiments of shower liner stay graspers when using a shower curtain 130 as a support member. Graspers 124J can be viewed in light of requiring no support members 118 by understanding grasper configurations. A FIG. 4A grasper 124 includes an object (referred to as a body) 124J-1 to leverage the support of a support member 118 (e.g. by a sleeve, by a compression fit, or by other attached/affixed embodiment) with an integration 452 to a grasp feature 124J-2 to perform grasping (integrated as one formed component, or attached). For example, the sleeves of graspers 124A, 124B, 124C, 124D, 124E and 124G comprise objects 124J-1 (referred to as bodies) and the compression fitting ring of grasper 124F comprises the 124J-1 body. A "body" referred to in this grasper 124 context, is an object of a particular material with suitable dimensions, and of any appearance, colors, shapes, etc. as appropriate for being adjacently held against shower curtain 130 in a stable engaged (coupled) position at desired point(s). Grasper 124A integrated face 402 with adhesive is the grasp feature 124J-2. Grasper 124B integrated face with adhesive is the grasp feature 124J-2. The grasper 124C integrated alligator clip is the grasp feature 124J-2. The grasper 124D integrated poking tip 450 is the grasp feature 124J-2. The grasper 124E-1 integrated hook with adhesive component 124E-2 is the grasp feature 124J-2. The grasper 124F ferromagnetic quality (for attracting a magnet) is the grasp feature 124J-2.

Thus, when using shower curtain 130 for support, graspers 124J include a shower curtain attachment member 124J-1 with integration 452 to a shower liner attachment member 124J-2. As described above, some graspers 124J may be viewed, or may be hidden, from the outside view of shower curtain 130. Thus, shower curtain attachment grasper member 124J-1 may comprise: a body/head on the outside view of shower curtain 130, a small body/head (e.g. threaded through shower curtain 130) for not being viewed, or an attachment body/head regardless of style, to shower curtain 130 (seen or unseen). Grasper member 124J-1 may further be retained adjacent shower curtain 130 with a slip prevention feature (e.g. adjustable collar at inside of shower curtain 130). Shower liner attachment grasper member 124J-2 will provide an appropriate grasp feature for grasping shower liner 112. For example, shower liner attachment grasper 124A member 124J-2 may be integrated (452) through use of snap (see 414), tip 450, female to male connection (or visa versa), a hook, a loop, a string, a cord or strap, a belt, a wire, a pin, or the like (and may be adjustable length), so face 402 is on the shower liner 112 side of shower curtain 130 when connected to member 124J-1. Similarly, shower liner attachment grasper 124B member 124J-2 may be similarly integrated (452) so a face is on the shower liner 112 side of shower curtain 130. Similarly, shower liner attachment grasper 124C member 124J-2 may be similarly integrated (452) so the alligator clip is on the shower liner 112 side of shower curtain 130. Similarly, shower liner attachment grasper 124D member 124J-2 can simply be poked through shower curtain 130 (preferably without damage to curtain 130), and in turn shower liner 112 (or alternatively tip 450 is an integration 452 (perhaps flexible or adjustable length) for being attached to a grasper member 124J-2 for grasping shower liner 112). Shower liner attachment grasper 124E-1 member 124J-2 may also simply be poked through shower curtain 130 (or alternatively the hook is integration 452 for being attached to a grasper member 124J-2 for grasping shower liner 112). Shower liner attachment grasper 124F member 124J-2 can be matched to a magnet 138 on the wet side of shower liner 112, or can be matched to another dry side shower liner attachment grasper member 124J-2 used in turn to grasp shower liner 112 via grasper portion 138 (e.g. magnetically).

There are many embodiments of an integration 452 with respect to shower curtain 130 for providing an appropriate grasper 124. Integration 452 and 454 provide a connectivity, a coupling, an attachment, an affixing, a bridge, a join, a connector, a linkage, a bind, a bond, or the like, with or without an adjustable length, with or without slip prevention features for shower curtain 130 or shower liner 112 (e.g. adjustably located collars opposite side), and firmly or flexibly for distancing apart shower curtain 130 and shower liner 112. Integration 452 and 454 may comprise a single part (or component, member, or the like), or a plurality of parts (or components, members, or the like) for coupling grasper member 124J-1 to grasper member 124J-2. For example, a flexible coupling between shower liner 112 and shower curtain 130 maintains a maximum distance, but a firm coupling between shower liner 112 and shower curtain 130 may maintain both a minimum and maximum distance.

Grasper 124K is a decorative body (member 124J-1) without one of the many alternate embodiment grasp features (member 124J-2) shown (backside of body 124J-1 is shown (i.e. surface of body in contact with shower curtain 130)). Grasper 124K is installed to shower curtain 130 for in turn grasping a shower liner 112 using shower curtain 130 for support (i.e. no support members 118). Grasper 124K body 124J-1 may include a slip preventing adjustable collar at the inside of shower curtain 130. Integration 454 (like 452) to a grasp member 124J-2 is used. The integration 454, or member 124J-2 itself, may maintain a desired distance between coupling point(s) of shower liner 112 and shower curtain 130. In other grasper 124 embodiments, at least a minimum body 124J-1, adjacent shower curtain 130 for using shower curtain 130 as support, is joined to, attached to, coupled to, affixed to, poked through or hosting a poke through, positioned at a supporting point in shower curtain 130, clipped to, clamped to, or the like, shower curtain 130. Body 124J-1 can be attached to a flexible hook, loop, belt, or the like (an integration 452) to a grasper feature (member 124J-2) for grasping shower liner 112 (with or without grasper portions 138 as applicable). Body 124J-1 can be attached to a firm pin, nail, fiber, shaft, rod, tack, staple, or other attachment means (may be flexible), or the like (e.g. an integration 454) to a grasper feature 124J-2 for grasping shower liner 112 (with or without grasper portions 138 as applicable). Body 124J-1 can be coupled to shower liner 112 using a grasper feature 124J-2 through shower curtain 130 (with or without grasper portions 138 as applicable). Grasper portions 138 below still apply to graspers 124 wherein shower curtain 130 is used for support.

When no support members 118 are required, the preferred shower liner stay product consists of a barcode marked package containing installation instructions, advertisement collateral (e.g. packaging header with title "Shower Liner Stay" and advertisement picture facilitating immediate product understanding), and the following shower liner stay components: one or more shower liner stay graspers and any applicable shower liner stay grasper portions, and any other applicable components (i.e. parts (e.g. adhesives, wires, hooks, loops, connections, pins, strings, etc), pieces, integration parts or components, or the like).

Figure 5:
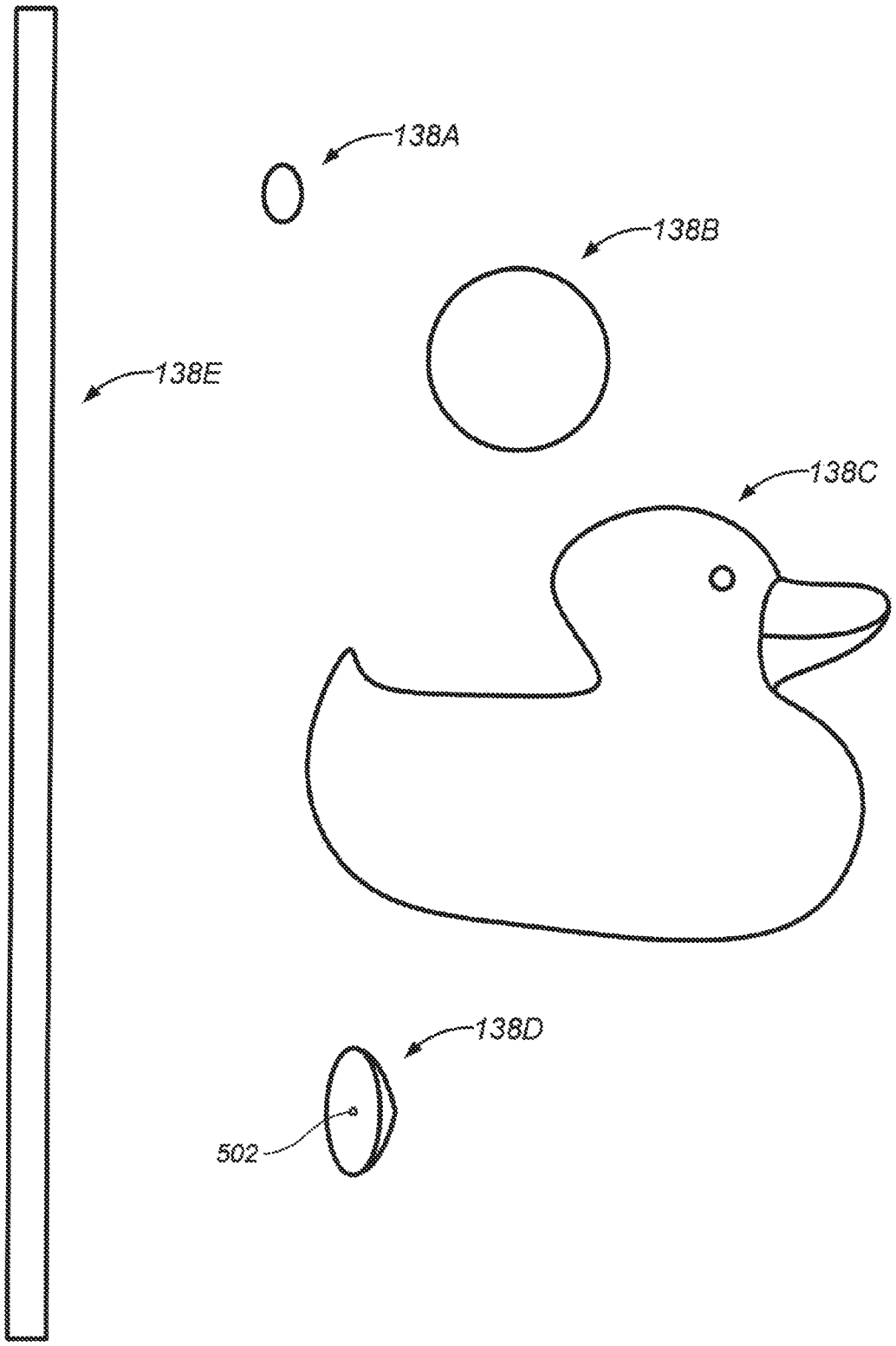
FIG. 5 illustrates alternate embodiments of shower liner stay grasper portions.

With reference now to FIG. 5, illustrated is alternate embodiments of shower liner stay grasper portions 138. A wet side grasper portion 138 couples (i.e. fastens to, binds with, engages, affixes to, attaches to, grasps, clasps, snaps to, holds to, or the like) a grasper 124 for sandwich of shower liner 112 thereby causing grasper 124 to grasp shower liner 112. Preferred embodiments of the shower liner stay product do not require a shower liner stay wet side grasper portion 138. Grasper portions 138 fall into the following categories: inconspicuous appearance primarily for adult users, child safe size to eliminate being a choking hazard, decorative appearance to enhance aesthetic qualities as viewed from within the bathtub when taking a shower, strategically sized to minimize the number of graspers 124, and in categories for achieving the engagement to grasper 124.

When used, grasper portion 138A is a magnet, preferably coated as described above. Any magnet with enough force to sufficiently sandwich shower liner 112 when coupled to a grasper 124 is applicable. Extremely tiny Neodymium magnets have demonstrated remarkable magnetic force for their size when used on the shower liner 112 wet side. Magnets may themselves be decorative. Grasper portion 138B comprises a magnet embedded into a larger object to ensure child safety. Polyethylene foams, similar to those used in pool toys (e.g. noodles) are excellent lightweight bodies for hosting a magnet glued therein (in some embodiments no glue is required by providing a chamber (or recessed cavity) to host a magnet with a smaller access to the chamber for inserting the magnet to stay held firmly therein for being difficult to remove). Polystyrene foams and any material that is lightweight is preferable for hosting the magnet of grasper portions 138B. Grasper portion 138C is an example decorative magnet body, and child safe body, similarly designed to component 138B (preferably having a contained magnet in a recessed cavity or chamber close to the optimal contact side of body 138C). In some embodiments, a body may be formed around a magnet when manufacturing the body. A "body" is an object of a particular material with suitable dimensions, and of any appearance, colors, shapes, etc. as appropriate for a grasper portion 138. Grasper portions 1388 and 138C may host any of the grasper portion coupling methods.

Grasper portion 138D is a cap for engaging a compressed fit to grasper 124D by inserting through the disposable liner 112 tip 450 to hole 502. Tip 450 may have features as described above for matching to a chamber (or complementary cavity) at the back of hole 502 for preventing tip 450 from slipping out. In another embodiment of grasper portion 138D, a female socket 502 matches stud 414 in a loose enough manner without a shower liner 112, that with a shower liner 112 being sandwiched, there is a tight engagement without damaging shower liner 112. Polyethylene foams are excellent examples for such snap configurations. Various embodiments of components 124G and 138D comprise a male component and female component, at either side of shower liner 112, for describing preferred fittings. Male components are best held in place by providing a chamber (or recessed cavity) at the back of an entry 502 in a female component for complementing a comfortable fitting to a male component (e.g. see stud 414) so as to retain the male within the female component. Many different designs of a male snapping into a female can be provided, depending on complementary design and material (e.g. plastic) used.

Grasper portion 138E comprises an elongated body that can host any of the wet side grasper portion 138 methods for better holding the shower liner 112 in place. Lightweight waterproof polyethylene or polystyrene foams provide excellent lightweight bodies. For example, a single grasper 124 may be used on a pensile wand 120 at a location about half the length of support member 118. Wet side grasper portion 138E prevents more of the liner from entering the shower area by virtue of more reinforcement body coverage (i.e. more shower liner 112 area coverage) adjacent the shower liner 112 wet side. Preferably, grasper portion 138E is vertically elongated assuming there a plurality of support members 118 in use, but any configuration, pattern, size, direction may be used. For example, a large lightweight "X" shaped body with coupling at the middle of the "X" body can require a single support member 118 dangling at the middle of the shower liner 112, and having a single grasper 124, perhaps even being a connector 202 at the middle of two rod portions 120 for double purpose. The only downside is having a large wet side grasper that may require occasional cleaning.

Figure 6:
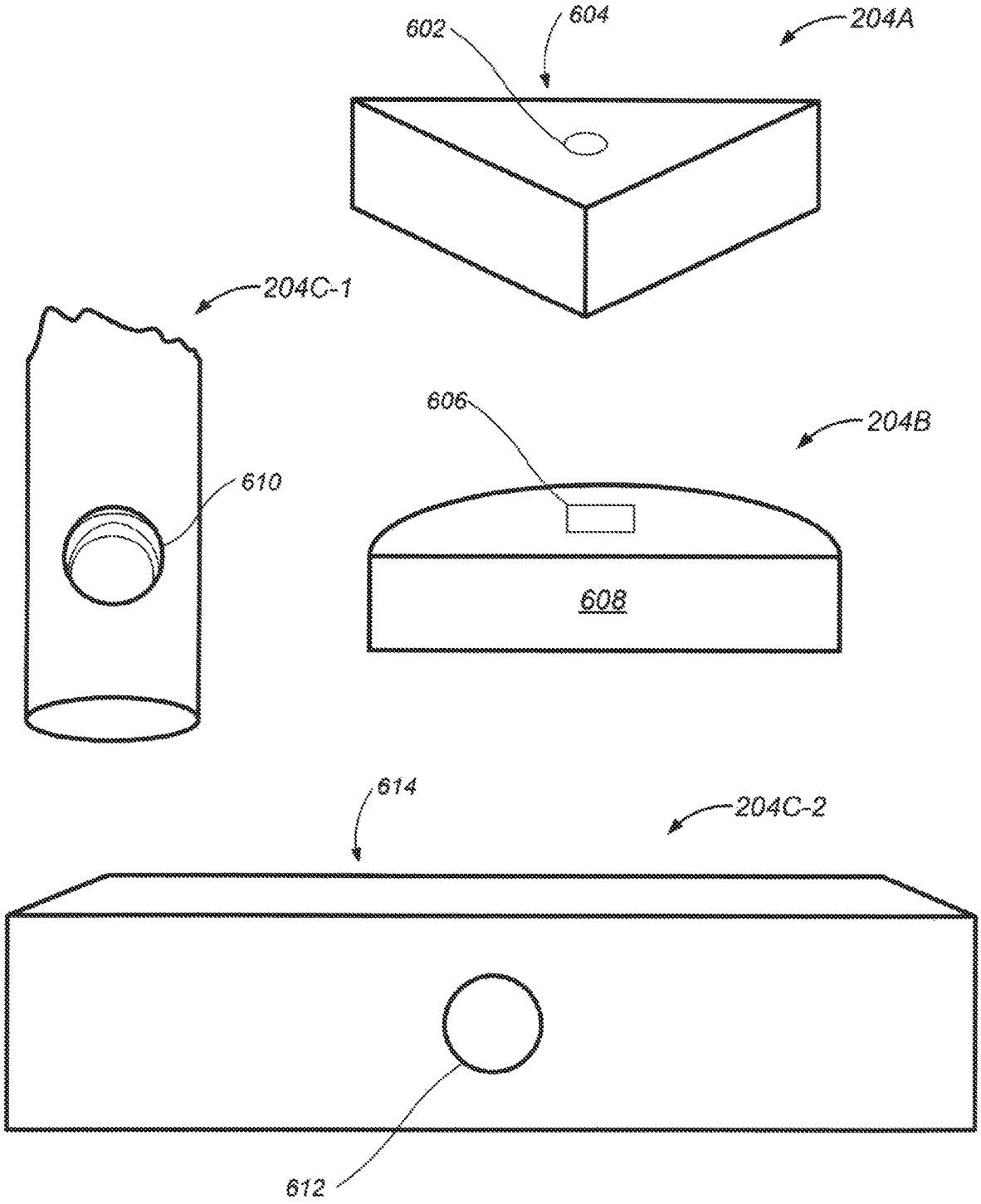
FIG. 6 illustrates alternate embodiments of shower liner stay padding entities.

FIG. 6 illustrates alternate embodiments of shower liner stay padding entities 204. Padding entity 204A is preferably a solid plastic foam (e.g. polystyrene or polyethylene foam) body with a hole 602 from top to bottom for receiving a pensile wand 120 using a push-on tight sleeve compression fit. After support member 118 is in a comfortable gravity and reasonably plumb position, padding entity 204A can be finally adjusted so that wide face 604 contacts tub 126 in a low friction manner. Face 604 should be wide enough to enable stability preventing member 118 from turning when opening or collapsing liner 112. Similarly, padding entity 204B is preferably a solid plastic foam (e.g. polystyrene or polyethylene foam) body with a hole 606 from top to bottom for receiving a pensile wand 120 using a push-on tight sleeve compression fit and having a wide enough face 608 to enable stability preventing member 118 from turning when opening or collapsing liner 112. Dimensions and shapes of holes throughout this disclosure (e.g. 604, 606), as well as bodies described, depends on pensile wand 120 dimensions, shapes, and sizes, as well as market preferences.

Padding entity 204C includes a threaded hole 610 in the bottom of a pensile wand 120 (i.e. breakaway bottom rod 204C-1) such that the threaded hole 610 is to be perpendicular to liner 112 as anticipated by pendent terminator 122 when pensile wand 120 is in a comfortable gravity and plumb condition. A lightweight plastic screw is to be adjustably screwed into hole 610 a desired distance, while the tip of the screw is inserted into depression 612 for a very tight compression fit. Upon completion of adjusting the plastic screw (not shown) so that a desired spaced apart relation of vertical alignment 134 to vertical alignment 136 is acquired, the body 204C-2 is turned clockwise or counter-clockwise using the screw end as an axis to be parallel to the floor so that face 614 glides across the outside surface of tub 126 while providing stability to prevent turning member 118. Padding entity 204C provides adjustability for moving the shower liner 112 closer or further away from the user of the shower. Alternate embodiments, may provide other adjustment designs.

In many cases, no padding entity 204 is needed. For example, support member 118 may already have a profile and material (or affixed parts) like examples in FIG. 6 wherein padding entity 204 functionality is provided. In alternate embodiments, padding entity 204 comprises a compression fit sleeve, or affixed material, of fabric, padding, cloth, felt, plastic, or the like to maintain distance from tub 126 and/or provide a scratch proof surface and/or provide less friction when opening or closing the liner 112. In child safe embodiments, padding entity 204 is sized appropriately and manufactured of a suitable material, and a screw is tightly screwed into threaded hole 610 to prevent removal. Other padding entity 204 embodiments may provide a plurality of distinct contact points with tub 126 and other adjustable designs. Still other embodiments of padding entity 204 are low cost bodies of plastic or material similar to 122D and 122E, as well as descriptions thereof.

Figure 7A:
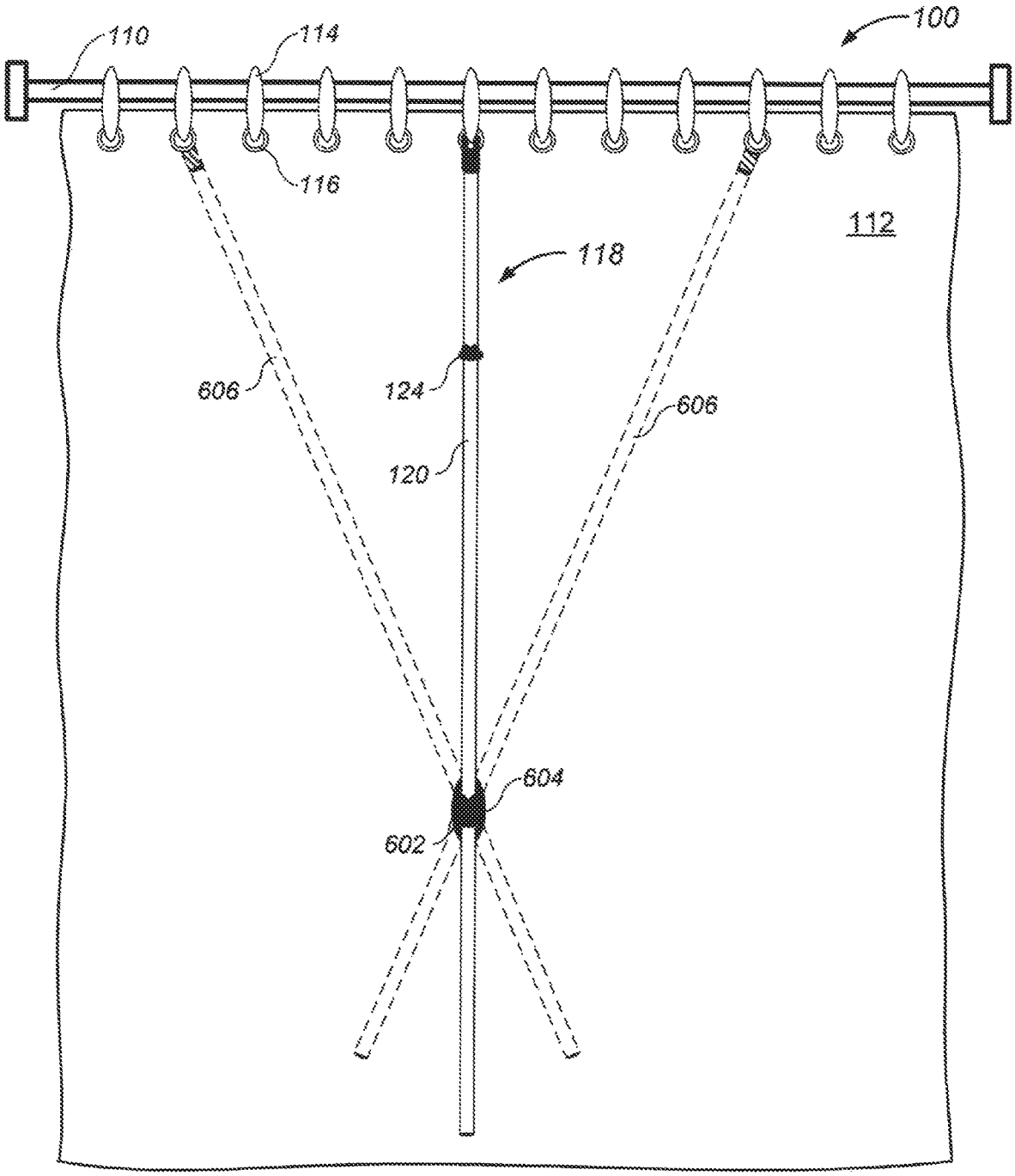
FIG. 7A depicts an alternate embodiment installation of the present disclosure.

With reference now to FIG. 7A, depicted is an alternate embodiment installation of the present disclosure. A single shower liner stay support member 118 dangles outside of the tub 126 while the shower liner 112 is inside tub 126. Strong aerodynamic conditions prevent pulling support member 118 into the tub with the shower liner 112. The bottom of support member 118 supported by the outside surface of the tub prevents shower liner 112 from being pulled toward the person taking a shower, even with the lightest materials used to make support member 118. Shower liner stay grasper 602 may be any of the embodiments discussed herein for dry side graspers 124 wherein a wet side grasper portion 138 is required. Wet side skeletal link 604 can be any of the embodiments discussed herein for wet side grasper portions 138 which couple to a particular dry side grasper 602. Skeletal link 604 is a special type of grasper portion 138 for being adapted to include a past-through guide accommodating one or more structural members 606 installed to the wet side of shower liner 112. This design facilitates having a single grasper 602 (e.g. single magnet or ferromagnetic metal) for coupling to a special wet side skeletal link 604 (e.g. complementary magnet or ferromagnetic metal for sandwich coupling) which physically holds liner 112 in place, while providing a structural presence for structural members 606. There are aesthetic qualities to such arrangements. Structural members 606 are shown as simple pensile wands 120 with only a pendent terminator 122 for dangling on the wet side of liner 112, but there may be one or more such members 606 of different shapes, angles, and patterns. Structural members 606 may have accordion joints, may intersect or interact with each other, and may have expansion/contraction features when operated. Additional graspers 124 may not be needed at all given the arrangement of wet side structural members 606. Once installed, structural members 606 cannot exit skeletal link 604. They simply glide using skeletal link 604 as a guide when shower liner 112 is spread open or collapsed. Thus, skeletal link 604 enables a grasper-less implementation using skeletal members of any design to retain liner 112 away from the showering area. Skeletal members 606, available in alternate shapes and configurations, provide reasonable rigidity adjacent the wet side surface of liner 112 to keep liner 112 away from the showering area. Support member 118 prevents inward movement of skeletal members 606.

Figure 7B:
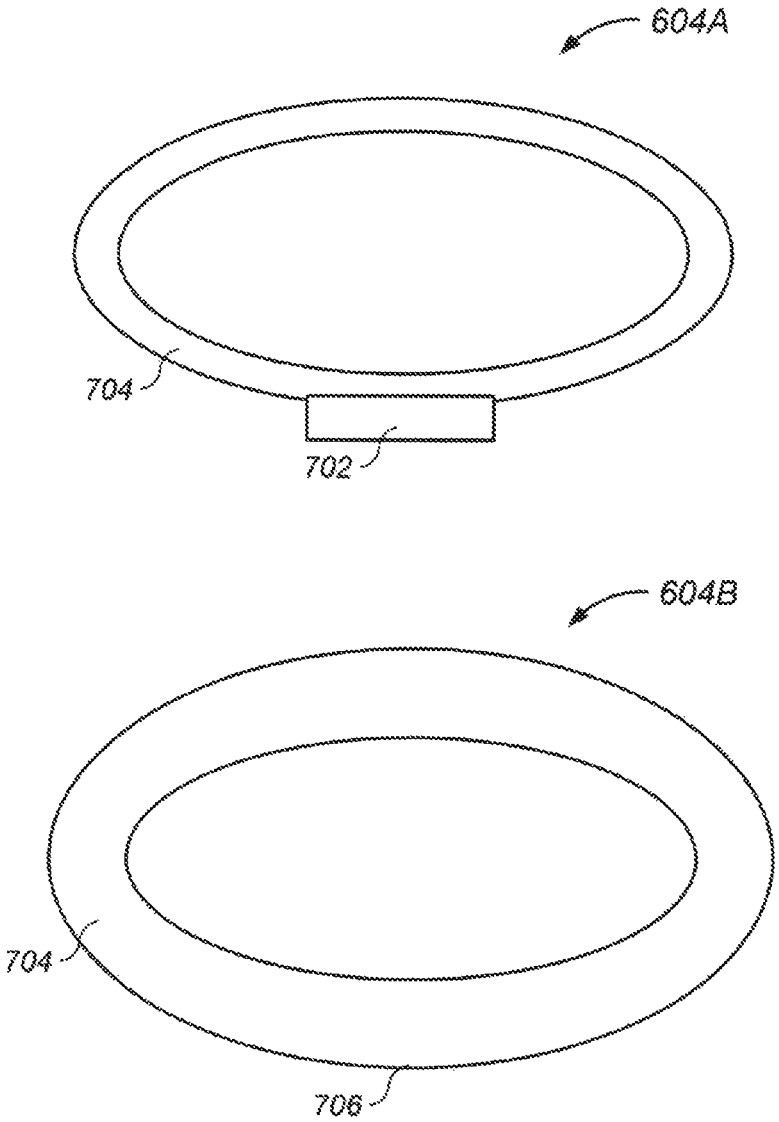
FIG. 7B illustrates alternate embodiments of shower liner stay skeletal links.

With reference now to FIG. 7B, illustrated is alternate embodiments of shower liner stay skeletal links 604 (top views). Skeletal link 604A includes a plastic ring 704 for receiving structural members 606, and includes an attached magnet 702 (e.g. glued). As a shower liner/curtain is spread open or collapsed, structural members 606 glide through ring 704 while magnet 702 is coupled to grasper 602. Turning of ring 704 is of no concern as long as magnet 702 holds the ring in place against grasper 602 of support member 118. Another embodiment is skeletal link 604B wherein magnet 702 in inserted into a chamber (or recessed cavity) of ring 704 through a smaller passageway to retain the magnet inside the body at about location 706. This requires no glue. Skeletal links 604 can be child safe. Ring 704 may be a variety of shapes, dimensions, colors, materials, etc, and could alternatively provide distinct pass-through guide rings (i.e. pass-through areas) for a plurality of structural members 606. In general, alternate shower liner stay product embodiments may use magnets on both sides of liner 112 (grasper 124 and grasper portion 138, or component 602 and component 604) to ensure a stronger attraction for sandwich of liner 112.

Company name and/or product name trademarks used herein belong to their respective companies.

While various embodiments of the present disclosure have been described above, it should be understood that they have been presented by way of example only, and not limitation. Thus, the breadth and scope of the present disclosure should not be limited by any of the above-described exemplary embodiments, but should be defined only in accordance with the following claims and their equivalents.

What is claimed is:

1. A shower liner stay installed adjacent a conventional flexible shower liner hanging from a shower curtain rod, comprising:

at least one substantially and intentionally straight pensile wand hanging vertically by gravity with a pendent terminator from a subjective curtain rod hanger on the shower curtain rod, the subjective curtain rod hanger selected by a user of the conventional flexible shower liner from any curtain rod hangers installed on the shower curtain rod, the pensile wand unenclosed by the conventional flexible shower liner beside a dry side surface of the conventional flexible shower liner and sandwiching the conventional flexible shower liner between the pensile wand and a grasper portion object at a wet side surface of the conventional flexible shower liner, the pendent terminator adjustably located by the user to any curtain rod location and including an end cap with an eyelet installed at a top end of the pensile wand, the eyelet having a loop for engaging the subjective curtain rod hanger, the conventional flexible shower liner having:

the wet side surface which faces a showering area, the dry side surface which is opposite the wet side surface, and no additional design feature for physically engaging the shower liner stay; and at least one of the grasper portion object installed by the user at the wet side surface adjacent a location of the pensile wand, the grasper portion object:

enabling the sandwiching the conventional flexible shower liner between the pensile wand and the grasper portion object at the wet side surface of the conventional flexible shower liner to hold in place the conventional flexible shower liner against the pensile wand at the grasper portion object without direct contact of the grasper portion object to the pensile wand, adjustably located by the user at the wet side surface adjacent the location of the pensile wand unenclosed by the conventional flexible shower liner beside the dry side surface of the conventional flexible shower liner, and providing the only intended engagement of the conventional flexible shower liner to the pensile wand.

2. The shower liner stay of claim 1 wherein the pensile wand is comprised of a plurality of connected pensile wands.

3. The shower liner stay of claim 1 wherein the pendent terminator includes a split ring to hang the pensile wand.

4. The shower liner stay of claim 3 wherein the end cap is flexible.

5. The shower liner stay of claim 1 wherein the pendent terminator includes a compression fit to the pensile wand.

6. The shower liner stay of claim 1 wherein the sandwiching the conventional flexible shower liner between the pensile wand and the grasper portion object at the wet side surface of the conventional flexible shower liner includes a magnetic coupling between the grasper portion object and an adjustably located object on the pensile wand.

7. The shower liner stay of claim 1 wherein the grasper portion object and pensile wand includes a mechanical coupling for sandwich of the conventional flexible shower liner.

8. The shower liner stay of claim 1 wherein the sandwiching includes a compression fit object to the pensile wand.

9. The shower liner stay of claim 1 wherein the sandwiching includes a male component and a female component.

10. The shower liner stay of claim 1 wherein the pensile wand includes a padding entity at the bottom of the pensile wand.

11. The shower liner stay of claim 10 wherein the padding entity is adjustable for adjusting a spaced apart relation from the showering area.

12. The shower liner stay of claim 1 including at least one skeletal member for joining the grasper portion object on the wet side surface.

13. The shower liner stay of claim 1 wherein the pensile wand is made of a material of fiberglass or carbon or graphite.

14. The shower liner stay of claim 1 wherein the pensile wand includes a rod of less than 5 mm in diameter or a tube of less than 5 mm in diameter.

* * * * *